US008713724B1

(12) United States Patent
Goettl et al.

(10) Patent No.: US 8,713,724 B1
(45) **Date of Patent: *May 6, 2014**

(54) POOL DRAIN ASSEMBLY WITH ANNULAR INLET

(75) Inventors: John M. Goettl, Phoenix, AZ (US); Steve R. Barnes, Maricopa, AZ (US)

(73) Assignee: GSG Holdings, Inc., Chandler, AZ (US)

( * ) Notice: Subject to any disclaimer, the term of this patent is extended or adjusted under 35 U.S.C. 154(b) by 575 days.

This patent is subject to a terminal disclaimer.

(21) Appl. No.: 13/041,828

(22) Filed: Mar. 7, 2011

Related U.S. Application Data

(63) Continuation-in-part of application No. 11/924,142, filed on Oct. 25, 2007, now Pat. No. 8,650,673, which is a continuation of application No. 10/894,803, filed on Jul. 20, 2004, now abandoned, which is a continuation-in-part of application No. 10/144,899, filed on May 14, 2002, now Pat. No. 6,810,537.

(51) Int. Cl.
*E04H 4/00* (2006.01)

(52) U.S. Cl.
USPC ..... 4/507

(58) Field of Classification Search
CPC ..... E04H 4/00; E04H 4/1236
USPC ..... 4/507, 292, 504; 210/163–164; 404/2, 404/4; 52/169.7
See application file for complete search history.

(56) References Cited

U.S. PATENT DOCUMENTS

| | | | |
|---|---|---|---|
| 59,804 | A | 11/1866 | Whitehead |
| 1,454,310 | A | 5/1923 | Booraem |
| 1,584,453 | A | 5/1926 | Hess |
| 1,792,345 | A | 2/1931 | Williams |
| 2,003,770 | A | 6/1935 | Goodhart |
| 2,695,678 | A | 11/1954 | Sisk |
| 2,749,999 | A | 6/1956 | Schmid |
| 2,777,532 | A | 1/1957 | Sisk |
| 3,247,968 | A | 4/1966 | Miller |
| 3,247,969 | A | 4/1966 | Miller |
| 3,313,515 | A | 4/1967 | Mullen, Jr. |
| 3,378,858 | A | 4/1968 | Jacuzzi |
| 3,408,006 | A | 10/1968 | Stanwood |
| 3,486,623 | A | 12/1969 | Bosico |

(Continued)

OTHER PUBLICATIONS

Maricopa County Environmental Health Code, Chapter VI, Bathing Places-Public and Semipublic Swimming Pools, Section 3, General Design Standards and Specifications, revision date Feb. 18, 2004, pp. 6-17 thru 6-24.

*Primary Examiner* — Lori Baker
(74) *Attorney, Agent, or Firm* — Booth Udall Fuller, PLC

(57) ABSTRACT

The swimming pool floor or spa floor drain assembly includes a drain cover having an annular upper opening to serve as a fluid flow inlet, a fluid flow opening within a drain body below the mouth and a sidewall interconnecting the annular upper opening with the fluid flow opening. A support structure positions the plug within the drain body such that a substantial portion of the plug sidewall is spaced apart from the drain body sidewall to define a fluid flow channel having a first comparatively larger cross sectional area in proximity to the drain body mouth and a second comparatively smaller cross sectional area in proximity to the drain body outlet. The variation in cross sectional area from the drain body mouth to the drain body outlet provides a lower fluid flow velocity at the mouth than at the outlet when fluid is transferred through the floor drain assembly.

19 Claims, 24 Drawing Sheets

(56) References Cited

U.S. PATENT DOCUMENTS

| | | | |
|---|---|---|---|
| 3,506,489 | A | 4/1970 | Baker |
| 3,675,252 | A | 7/1972 | Ghiz |
| 3,703,302 | A | 11/1972 | Demler |
| 3,940,807 | A | 3/1976 | Baker et al. |
| 4,114,206 | A | 9/1978 | Franc |
| 4,115,878 | A | 9/1978 | Johnson et al. |
| 4,460,462 | A | 7/1984 | Arneson |
| 4,487,219 | A | 12/1984 | Makela et al. |
| 4,503,573 | A | 3/1985 | Handzel |
| 4,505,814 | A | 3/1985 | Marshall |
| 4,561,134 | A | 12/1985 | Mathews et al. |
| 4,658,449 | A | 4/1987 | Martin |
| 4,907,610 | A | 3/1990 | Meincke |
| 4,910,811 | A | 3/1990 | Izzi, Sr. |
| D319,295 | S | 8/1991 | Ohaus |
| 5,135,579 | A | 8/1992 | Goettl |
| 5,265,631 | A | 11/1993 | Goettl |
| 5,268,096 | A | 12/1993 | Robol |
| 5,341,523 | A | 8/1994 | Barnes |
| 5,408,706 | A | 4/1995 | Barnes |
| 5,734,999 | A | 4/1998 | Nicholas |
| 5,753,112 | A | 5/1998 | Barnes |
| 5,759,414 | A | 6/1998 | Wilkes et al. |
| 5,799,339 | A | 9/1998 | Perry et al. |
| 5,822,807 | A | 10/1998 | Gallagher et al. |
| 5,878,773 | A | 3/1999 | Robol |
| 5,947,700 | A | 9/1999 | McKain et al. |
| 5,978,981 | A | 11/1999 | Nelson |
| 5,991,939 | A | 11/1999 | Mulvey |
| 6,038,712 | A | 3/2000 | Chalberg et al. |
| 6,088,842 | A | 7/2000 | Barnett |
| 6,098,654 | A | 8/2000 | Cohen et al. |
| 6,170,095 | B1 | 1/2001 | Zars |
| 6,230,337 | B1 | 5/2001 | Barnett |
| 6,341,387 | B1 | 1/2002 | Zars |
| 6,419,840 | B1 | 7/2002 | Meincke |
| 6,438,766 | B1 | 8/2002 | Capdevila Arnau et al. |
| 6,738,994 | B2 | 5/2004 | Barnett et al. |
| 6,810,537 | B1 | 11/2004 | Barenes et al. |
| 7,089,607 | B2 * | 8/2006 | Barnes et al. ..... 4/508 |

* cited by examiner

POOL DRAIN ASSEMBLY WITH ANNULAR INLET

CROSS REFERENCE TO RELATED APPLICATIONS

The present application is a continuation-in-part application of U.S. patent application entitled "SWIMMING POOL DRAIN," to Goettl, et al., Ser. No. 11/924,142, filed Oct. 25, 2007, which application is a continuation of U.S. patent application entitled "SWIMMING POOL DRAIN," to Goettl, et al., Ser. No. 10/894,803, filed Jul. 20, 2004, which application is a continuation-in-part application of U.S. Pat. No. 6,810,537 entitled "POOL FLOOR DRAIN ASSEMBLY FOR A SUCTION-ACTIVATED WATER CIRCULATION SYSTEM", to Goettl, et al., Ser. No. 10/144,899 filed May 14, 2002, the disclosures of all of which are hereby incorporated herein by reference for their various additional embodiments and beneficial disclosures.

BACKGROUND

1. Field of the Invention

The present disclosure relates to swimming pool and spa floor cylindrical drain assemblies that reduce flow velocity to prevent the entrapment of persons, clothing or hair against the drain.

2. Description of the Prior Art

Most swimming pools and spas, whether of concrete/gunite, fiberglass or having a vinyl liner above ground or in ground, include a drain at the lowest point. The purpose of the drain is to provide an outlet for flow of water from the swimming pool to the suction side of a pump. The outflow of the pump is passed through a filter to remove entrained matter. The filtered water is returned to the swimming pool at above and/or below water level outlets in the pool. Usually, the suction line from the drain includes a debris trap upstream of the pump to collect large sized debris.

The drain itself includes an apertured cover for passing water therethrough but prevents the inflow of large sized debris as a function of the size of the apertures or slots in the drain cover. A high flow rate of the water through the suction line is desirable to filter a large quantity of water within a given time period to help maintain clarity of the water. A high flow rate through the drain cover can only be brought about by maintaining a high suction force beneath the drain cover in order to draw water through the apertures of the drain cover. Such high suction force creates a potentially severe health hazard to a user of the pool or spa.

If a person were proximate the drain cover and a body part of the person came close to the drain cover, the suction force present would tend to draw the body part against the drain cover. Once the drain cover is covered by the body part, significant force by the person would be required to move away from the drain. Particularly children and those persons physically enfeebled may not have the requisite strength or capability to overcome the suction force acting upon them; as a result, they are likely to drown.

If a person in a swimming pool or spa wears loose clothing and comes into proximity with the drain of a swimming pool or spa, the material of the clothing may be drawn into or cover the drain. In such event, the suction force acting upon the material may be sufficient to prevent the person from moving away from the drain. For persons with long full hair, the hair is readily drawn into the swimming pool/spa drain and may twist upon itself beneath the drain cover to the extent that extraction becomes impossible. The potential consequences of both clothing and hair becoming entrapped by the drain in a swimming pool or spa may be fatal.

SUMMARY

In a first aspect, a drain assembly for installation in a floor of a pool may comprise a cover comprising at least one opening therethrough defining an annular upper opening with a planar cross-sectional area, the annular upper opening serving as a fluid flow inlet from a swimming pool to a pump, the cover further comprising a fluid deflecting plug supported within the annular upper opening from a side of the cover such that a majority of the fluid deflecting plug is suspended within the annular upper opening and spaced apart from the cover to define an opening to a fluid flow channel through the cover, and a cylindrical drain body comprising a fluid flow opening with a planar cross-sectional area positioned below and substantially parallel to the annular upper opening cross-sectional area when the cover is coupled to the drain body, wherein the fluid flow opening and the upper opening are non-concentric.

Particular implementations of a drain assembly may comprise one or more of the following features. The cover may further comprise a sidewall between the annular upper opening and the fluid flow opening, the sidewall defining a fluid flow channel extending between the annular upper opening and the fluid flow opening. The drain body may include a second fluid flow opening positioned below the annular upper opening, wherein the second fluid flow opening and the upper opening are non-concentric. The annular upper opening may comprise a longitudinal axis perpendicular to its planar cross-sectional area and the second fluid flow opening comprising a longitudinal axis, wherein the longitudinal axis of the annular upper opening and the longitudinal axis of the second fluid flow opening are substantially parallel to each other. The second opening may be one of a return line and a hydrostatic inlet. The sidewall may comprise an upper vented portion adjacent the upper opening and a lower non-vented portion such that the second fluid flow opening is positioned on a first side of the lower non-vented portion of the sidewall and the fluid flow opening is positioned on a second side of the lower non-vented sidewall separated from the first side such that the second fluid flow opening is separate from the fluid flow channel defined by the sidewall and is substantially not in fluid communication with the fluid flow opening except through the upper vented portion of the sidewall. The drain body may further comprise a third fluid flow opening positioned below and non-concentric with the annular upper opening, the third fluid flow opening comprising a longitudinal axis, and wherein the longitudinal axis of the third fluid flow opening is substantially parallel to the longitudinal axis of the annular upper opening and to the longitudinal axis of the second fluid flow opening. The second opening may be a return bypass line and the third opening is a hydrostatic inlet. A connector may be coupled between the cover sidewall and the fluid flow opening and securing the fluid flow channel from the sidewall to the fluid flow opening. A first suction line may comprise an enclosed body with a first open end coupled to the fluid flow opening and a second open end coupled to a first open end of a second suction line further comprising an enclosed body with a second open end, wherein the first suction line comprising a diameter at least 25% larger than a diameter of the second suction line. A low velocity flow zone may comprise a volumetric flow extending from a top perimeter of the annular upper opening to the second end of the first suction line such that a flow velocity through the second suction line is at least four times greater than the flow velocity within the first suction line and the flow velocity throughout the low velocity flow zone maintains a flow velocity approximately equal to or less than the flow velocity within the first suction line.

According to another aspect, a drain assembly for installation in a floor of a pool may comprise a cover defining an annular upper opening with a planar cross-sectional area, the upper opening serving as a fluid flow inlet from a swimming pool to a drain, a drain body comprising an annular fluid flow opening with a planar cross-sectional area positioned below and substantially parallel to the annular upper opening, wherein the drain outlet and the upper opening are non-concentric, wherein the cover comprises a sidewall comprising an upper vented portion adjacent to the annular upper opening and a lower non-vented portion defining a fluid flow channel extending from the annular upper opening to the fluid flow opening of the drain body, a first suction line, comprising a first diameter, coupled to the drain body at a first end of the first suction line and coupled to a second suction line at a second end of the first suction line opposite the first end, the second suction line comprising a second diameter smaller than the first diameter of the first suction line and wherein, every point on the top perimeter of the annular upper opening is at least about 16 inches from the second end of the first suction line when measured linearly along a fluid flow path from each respective point on the top perimeter of the annular upper opening to the second end of the first suction line, and a low velocity flow zone comprising a volumetric flow extending from the top perimeter of the annular upper opening to the second end of the first suction line such that a flow velocity through the first suction line is at least approximately 25% of the flow velocity within the second suction line and the flow velocity throughout the low velocity flow zone maintains a flow velocity approximately equal to or less than the flow velocity within the first suction line, wherein the low velocity flow zone extends outward of the top perimeter.

Particular implementations of a drain assembly may comprise one or more of the following features. A flow velocity through the second suction line of approximately 6 feet per second and a flow velocity within the first suction line of approximately 1.5 feet per second or less maintains a flow velocity of approximately 1.5 feet per second or less throughout the low velocity flow zone. The drain body may includes a second fluid flow opening positioned below the annular upper opening, wherein the second fluid flow opening and the upper opening are non-concentric. The second fluid flow opening may be one of a return bypass line and a hydrostatic inlet. The second fluid flow opening may be positioned on a first side of the lower non-vented portion of the sidewall and the fluid flow opening is positioned on a second side of the lower non-vented sidewall different from the first side such that the second fluid flow opening is separate from the fluid flow channel defined by the non-vented sidewall and is not in fluid communication with the fluid flow opening except through the upper vented portion of the sidewall. The annular upper opening may comprise a longitudinal axis perpendicular to the planar cross-sectional area of the annular upper opening and the second fluid flow opening comprising a longitudinal axis, wherein the longitudinal axis of the fluid flow opening and the longitudinal axis of the second fluid flow opening are substantially parallel to each other. The drain body may further comprise a third fluid flow opening positioned below and non-concentric with the annular upper opening, the third fluid flow opening comprising a longitudinal axis, and wherein the longitudinal axis of the third fluid flow opening is substantially parallel to the longitudinal axis of the second fluid flow opening. The second opening may be a return line and the third opening is a hydrostatic inlet. A flexible connector may be coupled between the cover sidewall and the fluid flow opening and securing the fluid flow channel from the sidewall to the fluid flow opening.

Aspects, implementations and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶ 6. Thus, the use of the words "function," "means" or "step" in the Description, Drawings, or Claims is not intended to somehow indicate a desire to invoke the special provisions of 35 U.S.C. §112, ¶6, to define the invention. To the contrary, if the provisions of 35 U.S.C. §112, ¶ 6 are sought to be invoked to define the claimed disclosure, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶ 6. Moreover, even if the provisions of 35 U.S.C. §112, ¶ 6 are invoked to define the claimed disclosure, it is intended that the disclosure not be limited only to the specific structure, material or acts that are described in the particular embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

Figure 10:
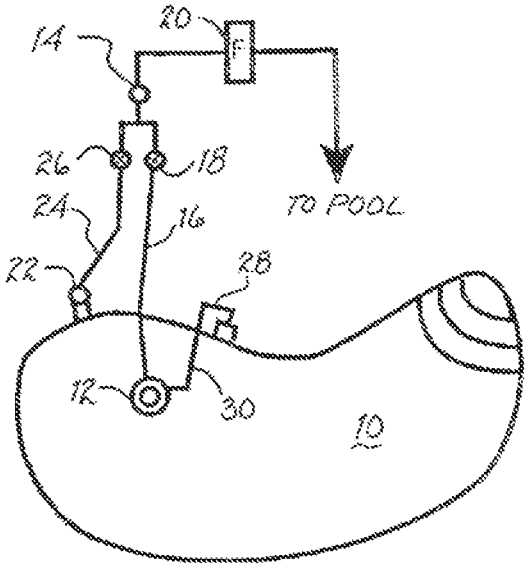
FIG. 10 represents a generalized schematic diagram illustrating how a pool floor drain assembly may be installed.
Figure 11:
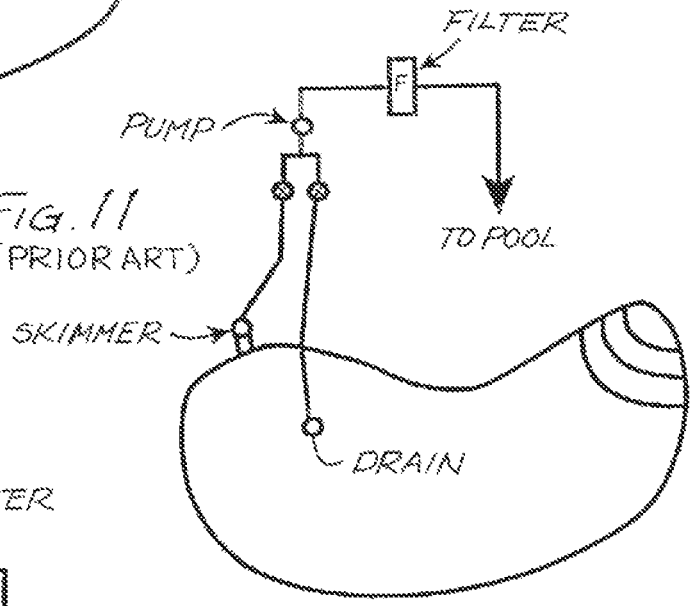
FIG. 11 (PRIOR ART)
FIG. 11 represents a schematic diagram of a pool using a prior art pool floor drain assembly.

FIG. 10 represents a generalized schematic diagram illustrating a swimming pool 10 including a swimming pool floor drain assembly 12 connected to pump 14 by pool suction or water return line 16 and valve 18. Pump 14 typically includes a pump filter basket. After passing through the pool filtration system 20, the filtered water is returned to pool 10. Skimmer 22 is connected by suction line 24 and valve 26 to pump 14. A secondary drain 28 or vacuum relief drain is interconnected with pool floor drain assembly 12 by alternate water return line 30. Vacuum relief drain 28 is most often installed on a pool sidewall but may just as well be installed in the pool floor at a predetermined minimum distance away from the main pool floor drain assembly 12. Since embodiments of a pool floor drain system may also be installed in a spa, the terms "pool" and "spa" will be used interchangeably.

Referring now to FIGS. 1-4, one particular embodiment of a pool floor drain assembly 12 will be described in detail. A drain sump 32 includes a bottom 34, a substantially cylindrical side surface 36 and an open top. A wedge shaped sealing lip 38 is positioned slightly inboard of the circular perimeter surface 40 of drain sump 32. Drain sump may alternatively be referred to herein as a drain body.

The bottom 34 of drain sump 32 includes an elongated, vertically oriented passageway 42. The FIG. 6 assembly drawing more clearly illustrates the individual component parts which are assembled and combined with the primary molded structural element 44 from which the complete drain sump 32 is fabricated. To facilitate molding, inlet 50 may be fabricated as a separate part and interconnected with the drain sump 32.

Figure 4:
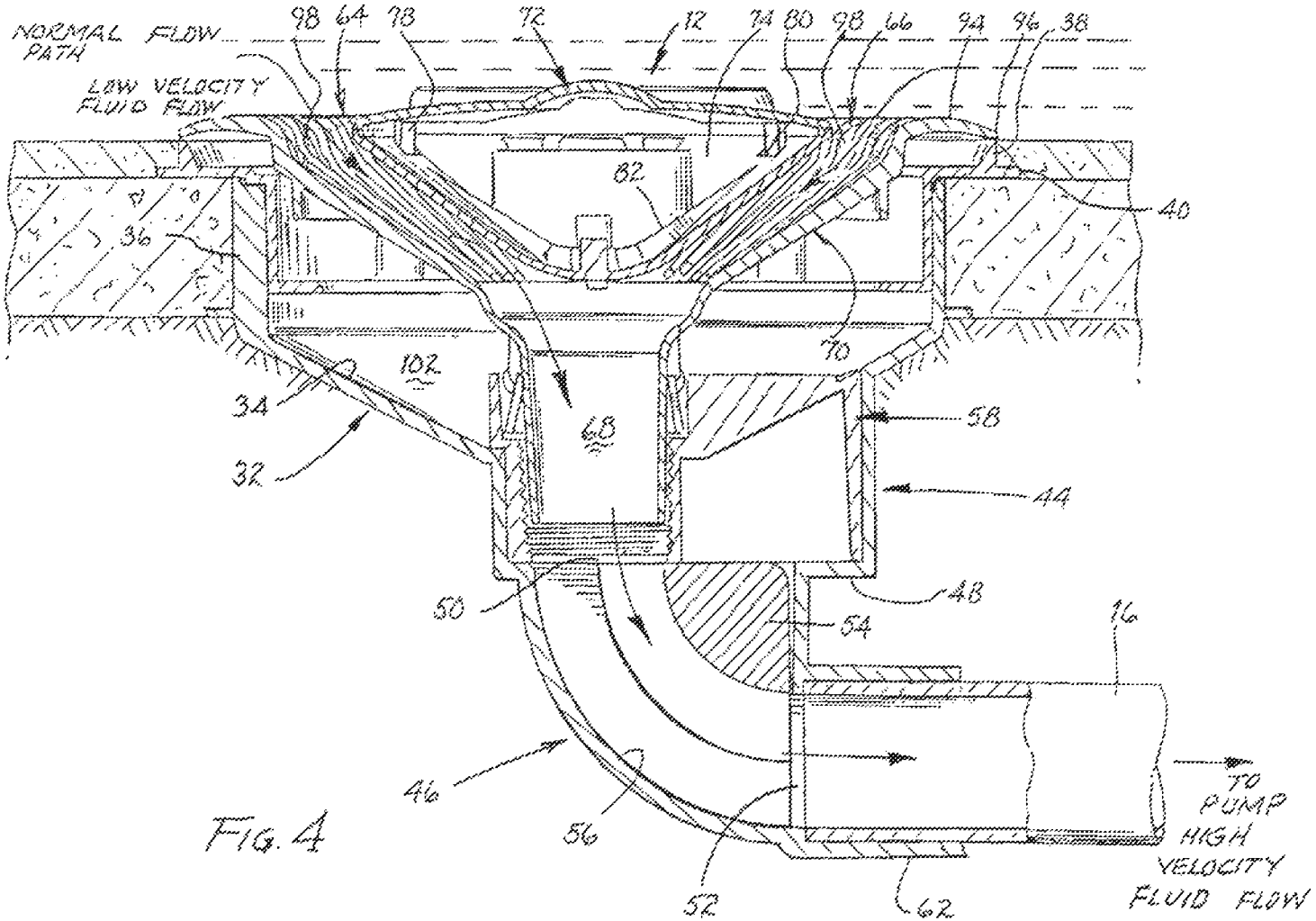
FIG. 4 represents a sectional view of the pool floor drain assembly illustrated in FIG. 1.
Figure 5:
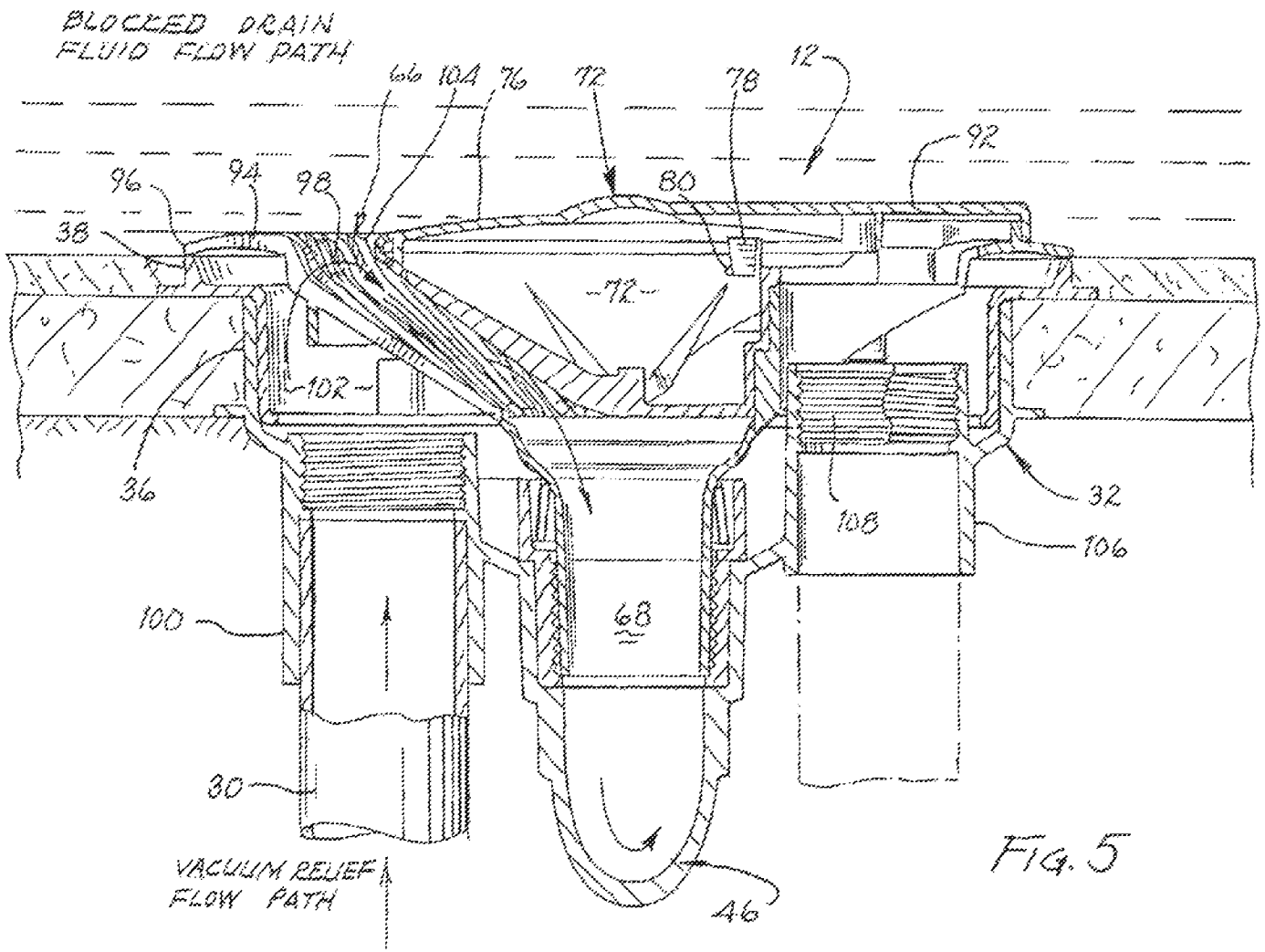
FIG. 5 represents a sectional view of the pool floor drain assembly illustrated in FIG. 1 taken from an angle different from that shown in FIG. 4.
Figure 6:
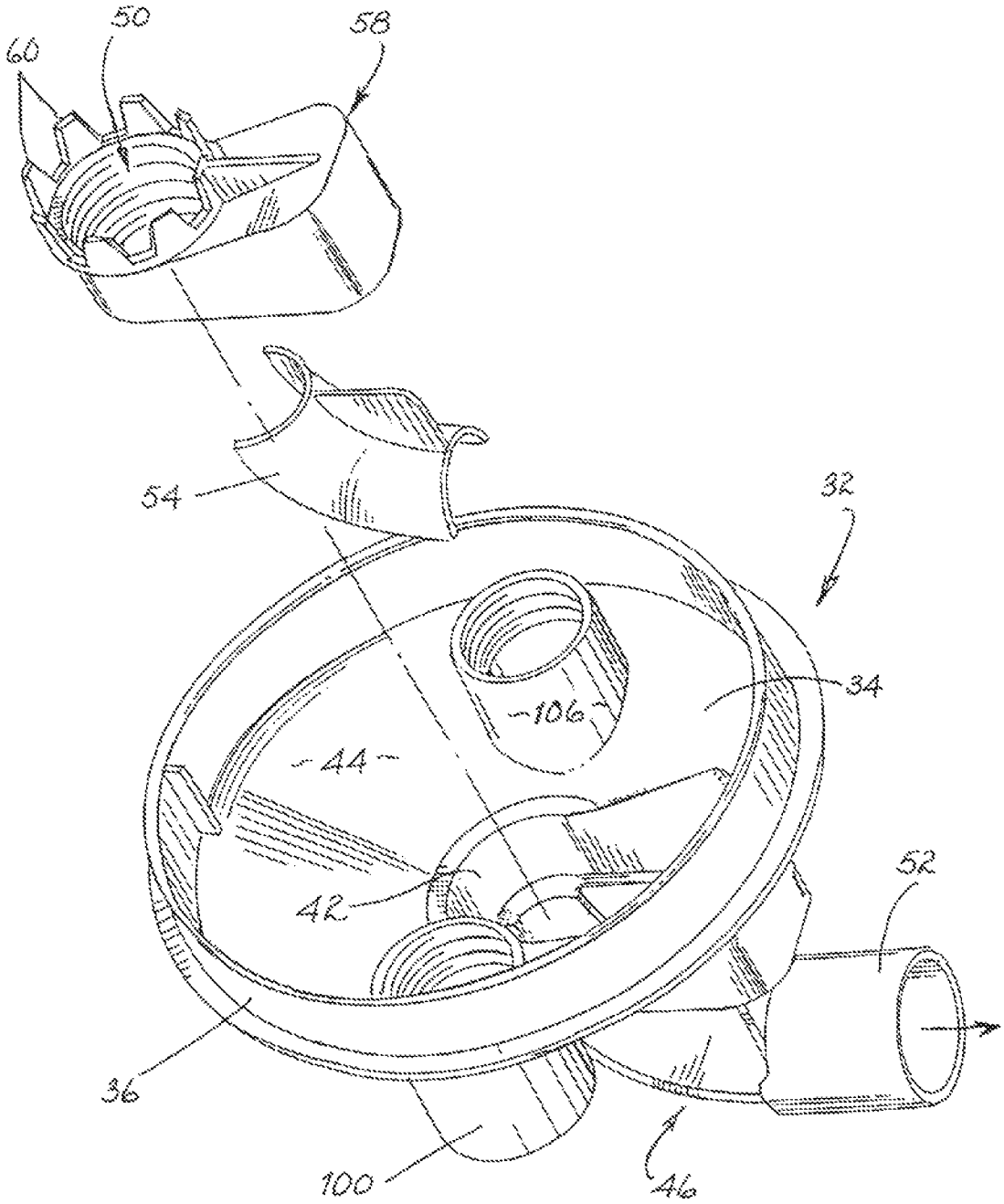
FIG. 6 represents an exploded perspective view of various elements of the pool floor drain assembly illustrated in FIG. 1.

As illustrated by FIGS. 4, 5 and 6, a vertical to horizontal fluid flow transition element 46 extends below the base 48 of drain sump 32 and includes a vertically oriented inlet 50 and a horizontally oriented outlet 52. As illustrated in the FIG. 6 assembly drawing, the inner portion 54 of fluid flow transition element 46 is individually molded and positioned adjacent to the outer portion 56 of fluid flow transition element 46 which is integrally molded with drain sump 32 to create the molded structural element 44 illustrated in FIGS. 4 and 6. Inner element 54 is typically placed into position during the assembly process without a glued together joint. Adapter element 58 is next placed into position and glued to molded structural element 44 as illustrated in the drawings. Adapter element 58 may include a plurality of radially spaced apart fingers 60. The interior surface of vertically oriented inlet 50 of adapter element 58 includes conventional female pipe threads.

Figure 9:
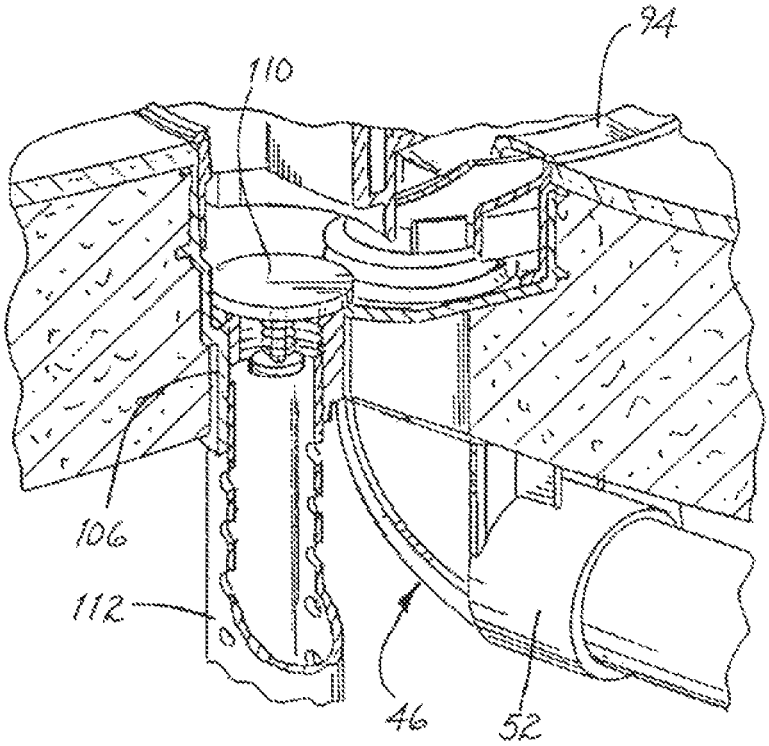
FIG. 9 represents a partially cutaway perspective view of a floor drain assembly installed in a pool and including a hydrostatic pressure relief valve.

As shown in FIGS. 4 and 9, the horizontally oriented outlet 52 of fluid flow transition element 46 includes a female receptacle 62 which facilitates coupling to the suction or water return line 16. FIG. 4 illustrates that fluid flow transition element 46 includes an internal passageway having a cylindrical cross section with a substantially constant diameter.

Figure 8:
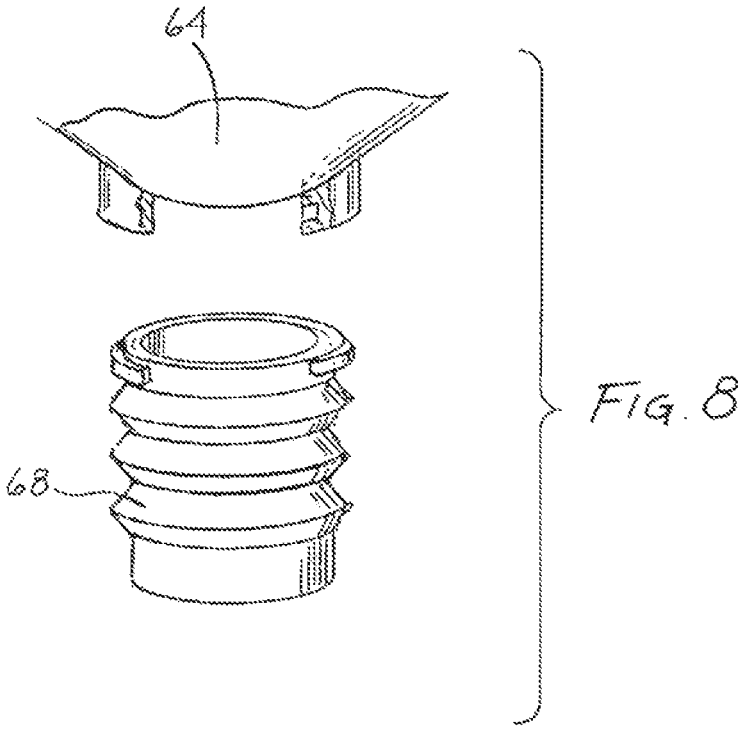
FIG. 8 represents a partially cutaway, exploded perspective view of the bayonet-mount coupling of the outlet portion of a drain body.

Referring now to FIGS. 1-5, the swimming pool floor drain assembly 12 of the present invention further includes a funnel shaped drain body 64 having a substantially circular mouth 66 which serves as a fluid flow inlet, a neck region 68 serving as a fluid flow outlet and a sidewall 70 interconnecting mouth 66 with neck 68. As is best illustrated in FIG. 4, neck 68 is dimensioned to fit within and form a fluid tight coupling with inlet 50. As shown in FIG. 8, neck 68 may be formed as a separate element and connected to the remainder of drain body 64 by a twist lock bayonet mount. The lower portion of the neck 68 of funnel shaped drain body 64 is dimensioned to inter-fit with and forms a relatively fluid tight seal with the female threaded portion of inlet 50 of adaptor element 58.

Figure 7:
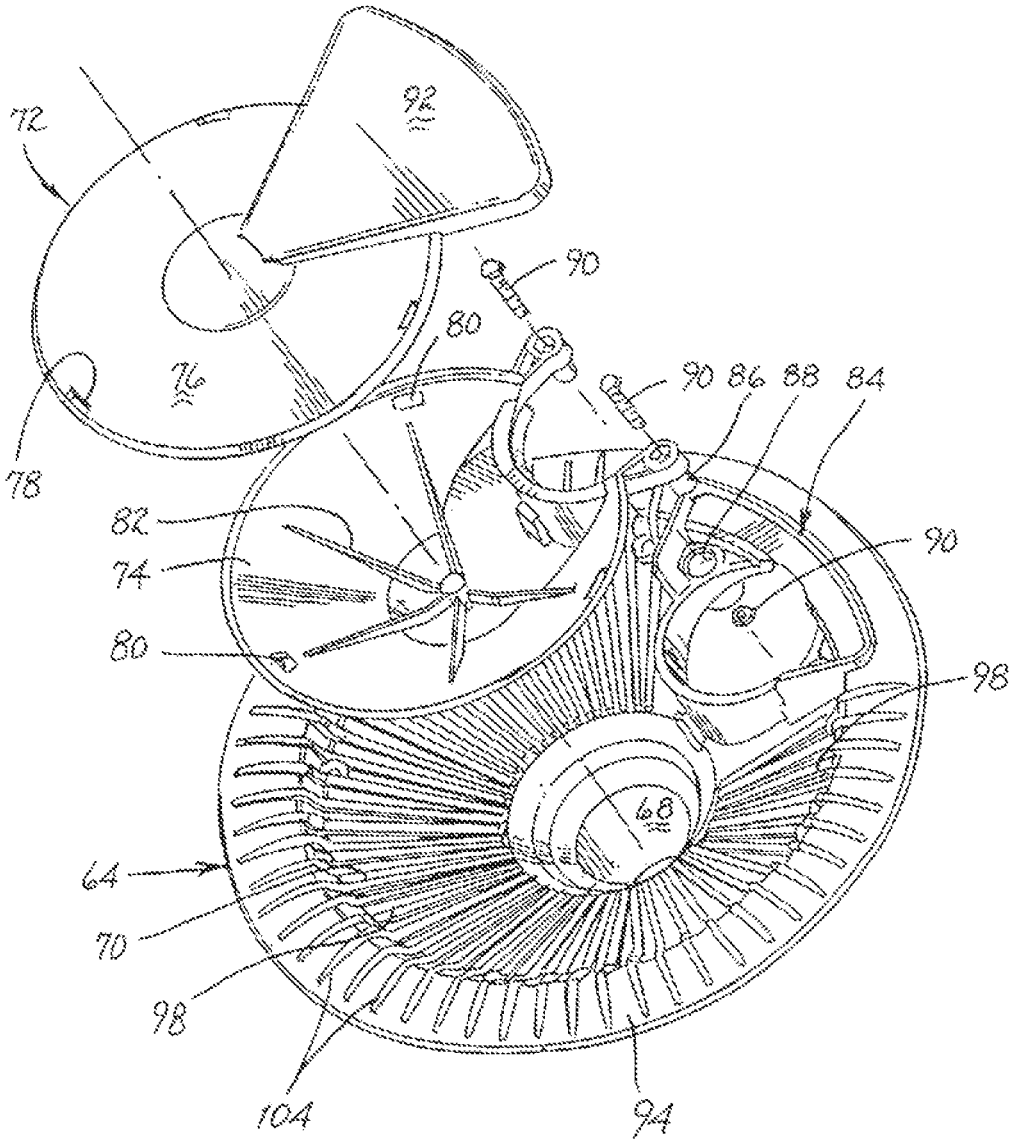
FIG. 7 represents an exploded perspective view of additional components of the pool floor drain assembly illustrated in FIG. 1.

The swimming pool floor drain assembly 12 also includes a fluid deflecting plug 72 in the form of a conical member which includes a V-shaped sidewall 74 dimensioned to fit within mouth 66 of funnel shaped drain body 64 as best illustrated in FIGS. 1-4. The bottom of the V-shaped sidewall 74 defines a closed lower end surface of the plug 72. Fluid deflecting plug 72 further includes a domed top 76 closing the upper end surface of the plug 72. As illustrated in FIG. 7, domed top 76 includes a plurality of three spaced apart, downwardly extending clips 78 which pass through and form a snap together fit with three matching slots 80 in sidewall 74 of plug 72. These elements may also be interconnected by screws. A plurality of vertically extending reinforcing ribs 82 may be formed on the interior surface of sidewall 74 to enhance the structural strength of plug 72.

As illustrated in FIG. 4, the outer portion of the top of funnel shaped drain body 64 includes a laterally extending lip 94 having a circular perimeter area 96 which overlaps with, contacts and forms a relatively fluid tight seal with the mated, upwardly projecting wedge shaped sealing lip 38 of drain sump 32. During the original installation process, funnel shaped drain body 64 may be screwed into vertically oriented inlet 50 of adapter element 58 until a relatively fluid tight seal is formed between the perimeter area 96 of funnel shaped drain body 64 and the wedge shaped sealing lip of drain sump 32.

Figure 3:
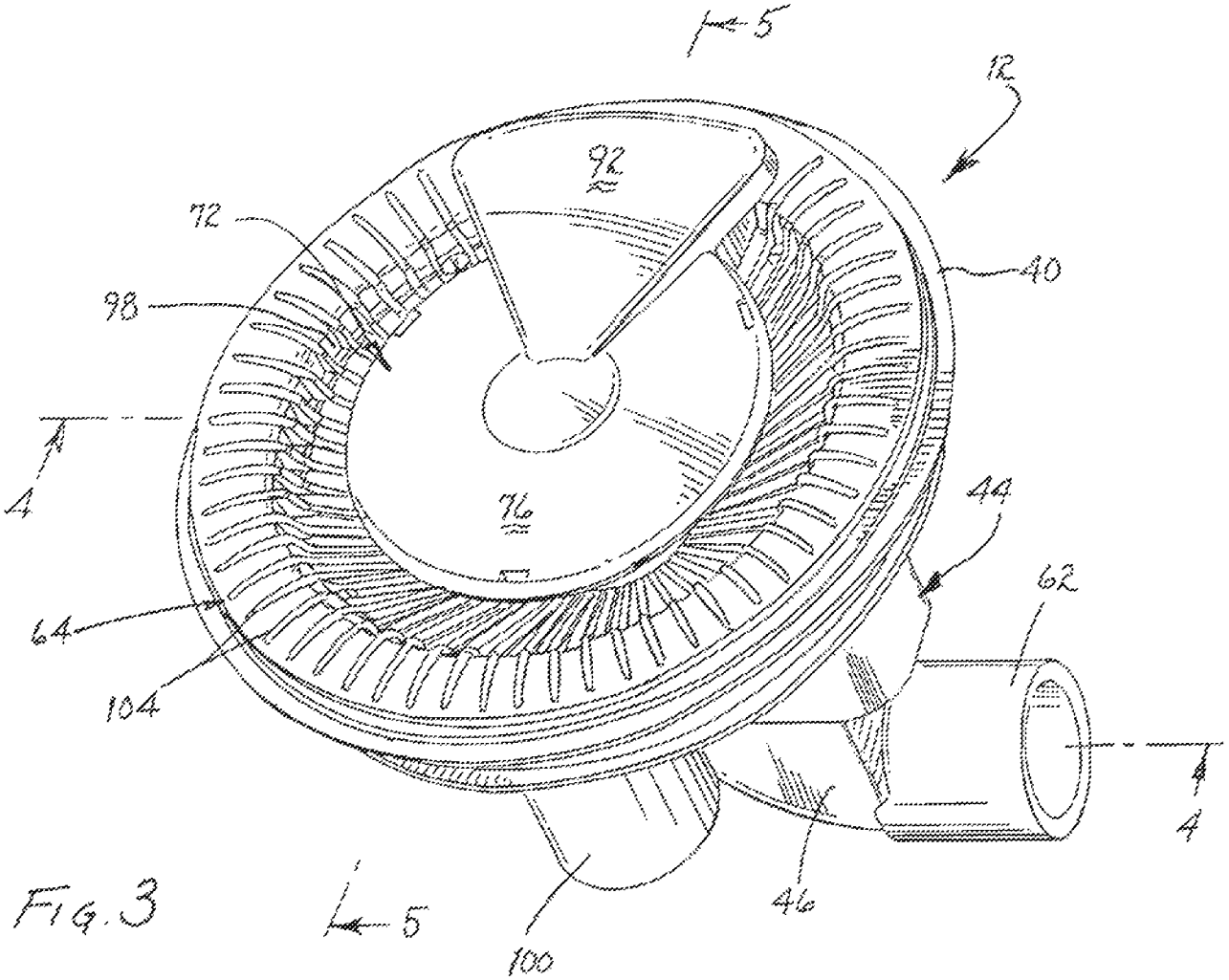
FIG. 3 illustrates a perspective view of a particular embodiment of a pool floor drain.

As best illustrated in FIGS. 3 and 7, a multi element support structure is generally illustrated by reference number 84 and serves as a rigid mechanical connection to secure fluid deflecting plug 72 within the interior of the funnel shaped drain body 64 and to maintain a fixed spacing between the sidewall 70 of funnel shaped drain body 64 and the sidewall 74 of fluid deflecting plug 72. The fixed spacing between sidewalls 70 and 74 defines a variable velocity fluid flow channel which extends from funnel mouth 66 to the funnel outlet or neck 68. The channel has a first cross sectional area in proximity to the funnel shaped drain body inlet and a second smaller cross sectional area in proximity to the funnel shaped drain body outlet to provide a reduced fluid flow velocity at the funnel shaped drain body inlet in comparison to the fluid flow velocity at the funnel shaped drain body outlet.

Support structure 84 may be configured as shown in FIG. 7 to include one or more plug-like vertical support elements or pegs 86 which interface with a complementary shaped drain body lateral support element such as one or more spaced apart recesses 88 which perform the function of rigidly coupling plug 72 to drain body 64. While these components may be permanently glued together, they may also be removably coupled together by removable coupling means such as stainless steel nuts and bolts 90 as illustrated in FIG. 7. The extended or fanned out portion 92 of domed top 76 serves the cosmetic function of covering support structure 84 after the pool floor drain assembly has been installed in the floor of the swimming pool.

Figure 1:
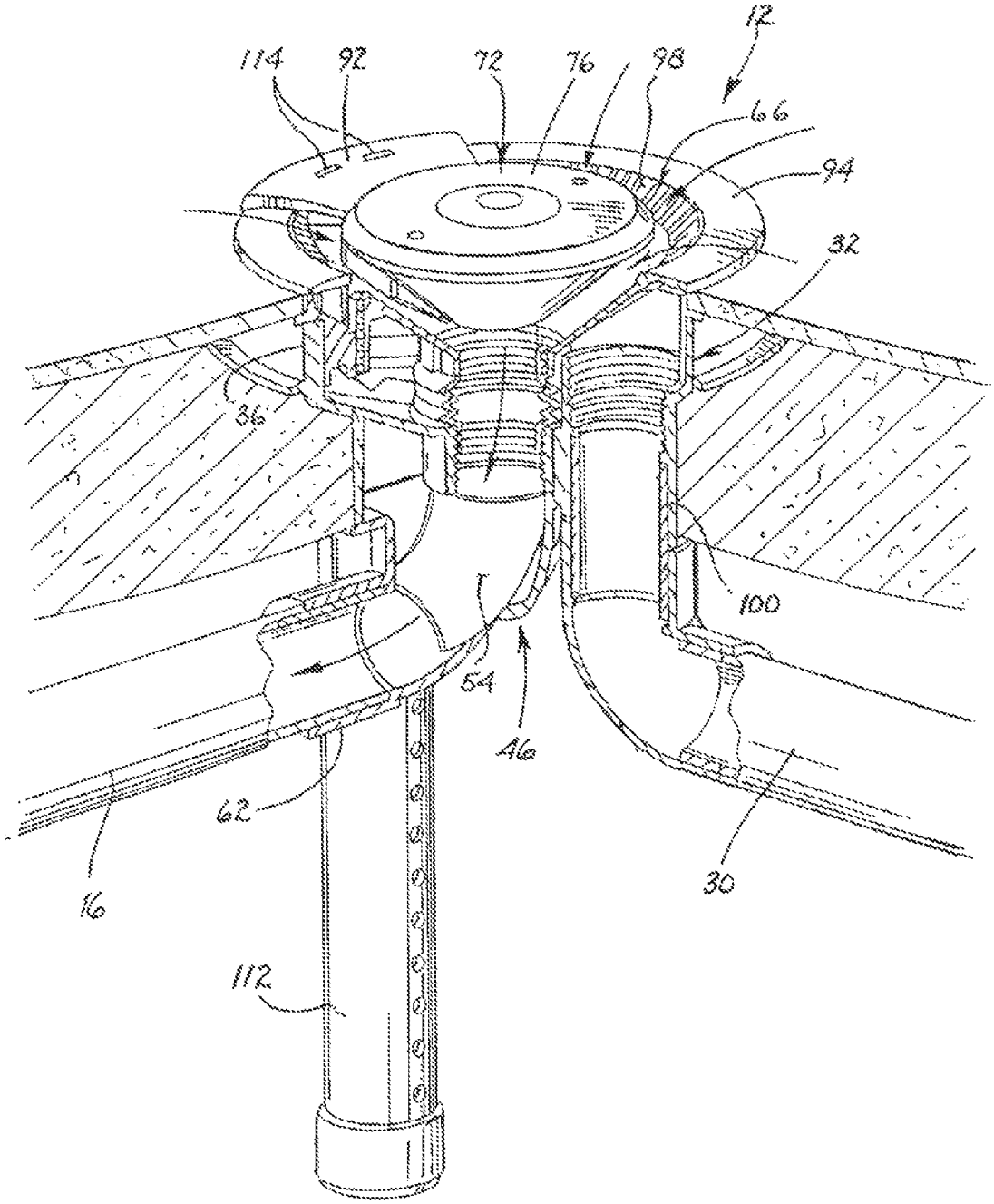
FIG. 1 illustrates a perspective view of an embodiment of a floor drain assembly with arrows illustrating the normal water flow when the drain body inlet remains unobstructed.

Various additional structural elements may be added to the basic embodiment of the pool floor drain assembly 12 to enable it to be coupled as illustrated in FIG. 10 by water return line 30 to the secondary or vacuum relief drain 28. This alternate or secondary fluid flow path is activated only when fluid flow through the inlet or mouth 66 of floor drain assembly 12 is interrupted, either partially or completely, by an obstruction such as a bather sitting or lying across mouth area 66 which either completely or partially blocks the normal fluid flow path as illustrated in FIGS. 1 and 3.

Figure 2:
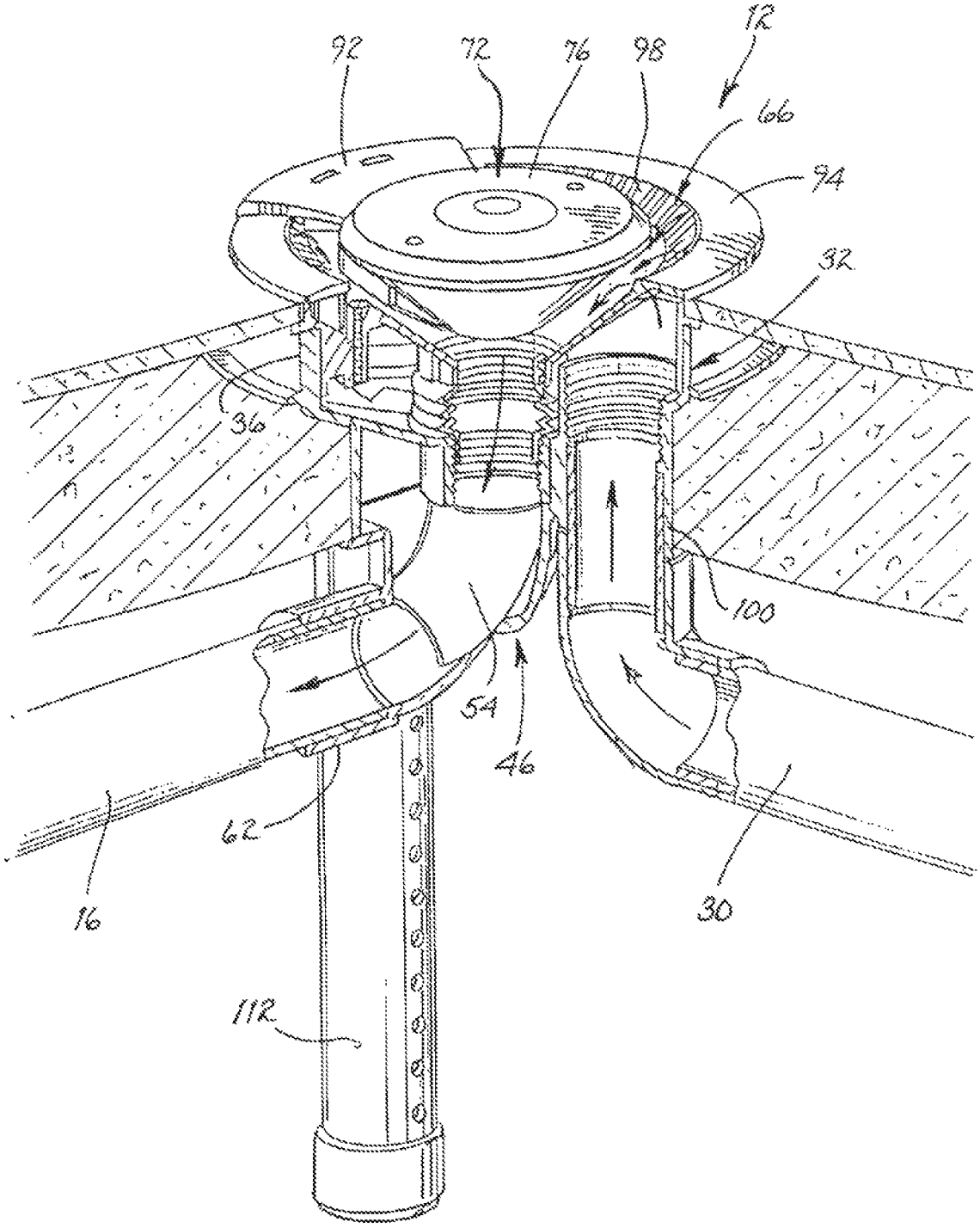
FIG. 2 illustrates the floor drain assembly of FIG. 1 with arrows showing a secondary water flow path which is activated when the primary inlet is at least partially obstructed.

The plurality of flow direction arrows depicted in the FIGS. 2 and 5 sectional views illustrate the alternate or secondary fluid flow path which is automatically activated when it becomes necessary to initiate fluid flow through vacuum relief drain 28 and alternate water return line 30. To facilitate this alternate or bypass water flow path, a plurality of laterally spaced apart, rectangular vacuum relief slots or fluid flow bypass apertures are formed in the sidewall 70 of funnel shaped drain body 64 just below the lip 94. Representative ones of these bypass slots or apertures are designated by reference number 98. As illustrated in FIGS. 3, 5 and 6, the bottom portion 34 of drain sump 32 includes a secondary fluid flow inlet 100 forming a water tight coupling with alternate return line 30.

As illustrated in FIGS. 1, 2, 4 and 5, a fluid distribution chamber or secondary chamber 102 is formed between and extends radially or coaxially around at least a portion of the funnel shaped drain body sidewall 70 and the interior of drain sump 32. Fluid distribution chamber 102 allows fluid to be transferred from secondary fluid flow inlet 100 through the plurality of fluid flow bypass slots 98 into the annular fluid flow channel formed between the sidewalls of funnel shaped drain body 64 and fluid deflecting plug 72. As illustrated by the fluid flow designating arrows in the FIGS. 2 and 5 drawings, in the bypass mode the flow of fluid continues downward through that channel, passes through the neck 68 of drain body 64, downward through fluid flow transition 46 and through water return line 16 to pump 14. The division of the fluid flow volume through the normal or primary flow path illustrated in FIG. 3 versus the alternate or secondary vacuum relief flow path illustrated in FIGS. 2 and 5 is determined by the degree of blockage or obstruction of the normal fluid flow path and the resulting internal pressure changes within the fluid flow channel between funnel shaped drain body 64 and fluid deflecting plug 72.

A plurality of ribs 104 projecting upward from the sidewall of funnel shaped drain body 64 may be provided to serve a number of different functions. First, ribs 104 will typically be located between adjacent fluid flow bypass slots 98 to maintain essentially laminar flow between the mouth 66 and neck 68 of funnel shaped drain body 64. Ribs 104 inherently provide enhanced structural rigidity which may be desirable in certain applications. The ribs are not necessary to the function and operation of the assembly.

As illustrated in FIGS. 1-5, the fluid flow bypass slots 98 have been located toward the top of the fluid flow channel between funnel shaped drain body 64 and fluid deflecting plug 72 and in proximity to the mouth 66 of drain body 64. Although fluid flow bypass slots 98 could be located anywhere along this internal fluid flow channel, placing them toward the top of the fluid flow channel optimizes the performance of particular pool floor drain assembly embodiments. For example, when leaves or other relatively large size debris are sucked through the mouth of floor drain assembly 12, the laminar fluid flow within the drain assembly rapidly moves such debris downward through the unobstructed fluid flow channel without requiring that the leaves or other debris be deformed or folded, a process which will ultimately take place when such large debris enters into and then passes through the substantially reduced diameter neck region 68 of funnel shaped drain body 64.

The unique configuration of the pool floor drain assembly of particular configurations similar to FIGS. 1-5, however, provides for a variable velocity fluid flow as the fluid passes between the inlet and outlet portions of funnel shaped drain body 64. For example, the inlet or mouth of the floor drain assembly 12 is configured as an unobstructed annular or ring shaped passageway having a comparatively large diameter and a comparatively large cross sectional area. Within the neck region 68 of the funnel shaped drain body 64, the diameter of the annular or ring shaped fluid flow passageway has been reduced to a minimum distance with a resulting substantial increase in the fluid flow velocity. This increased fluid flow velocity readily crushes, folds and otherwise deforms large debris such as leaves, thereby performing a function necessary to ensure the transfer of leaves from neck section 68 through water return line 16 to pump 14 where such leaf like debris can be extracted in the pump filter basket and periodically removed by the pool user.

One particular advantage of pool floor drain assemblies configured according to principles of this disclosure is that it entirely avoids the prior art requirement for a floor drain grate assembly to filter out large size debris such as leaves. Grate assemblies are required to filter out large debris from conventional pool drains.

Figure 12:
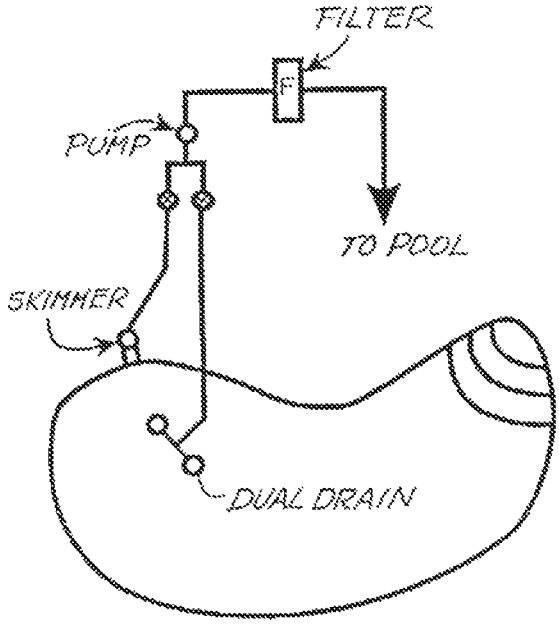
FIG. 12 (PRIOR ART)
FIG. 12 represents a schematic diagram of a pool using a prior art pool floor drain assembly.

Floor drain systems are typically formed as a rectangular or circular cavity with a water return line extending either vertically downward and out of the floor drain bottom or horizontally out the side of the cavity style floor drain. In both cases, non-uniform flow exists within the interior of the floor drain. Were a relatively small apertured grating not provided on the top of such conventional cavity style floor drain assemblies, large leaf like debris would be pulled into the interior of the pool drain cavity and over time would accumulate and fully obstruct the interior volume of the floor drain cavity, plug the water outlet and require activation of a secondary or alternate floor drain which, as illustrated in FIG. 12, is typically spaced at least three feet apart from the primary drain. Once that first conventional floor drain becomes clogged, the advantages gained from secondary drain bypass feature necessary for bather safety will have been lost. In particular embodiments and implementations of a pool floor drain assembly disclosed herein, on the other hand, by receiving and extracting from the pool floor such large leaf like debris entirely avoids the problem experienced by conventional prior art cavity style pool floor drain designs.

An additional advantage of the annular, funnel shaped fluid flow channel formed between the funnel shaped drain body 64 and fluid deflecting plug 72 is that the safety code requirement for a relatively low 1.5 foot per second fluid flow rate at the pool floor drain mouth or inlet at the surface of the pool floor is readily achieved due to the substantially larger fluid flow channel area at the mouth of the funnel shaped floor drain in comparison to the substantially smaller cross sectional area of the neck 68 of the drain assembly.

The domed top 76 of fluid deflecting plug 72 forms an elevated surface relative to the pool floor which performs the additional function of elevating a bather's body above the mouth of the pool floor drain assembly, a feature which may render it more difficult for a bather to inadvertently obstruct either all or part of the mouth portion of the pool floor drain assembly.

Incorporation of the vertical to horizontal fluid flow transition element 46 as an integral element of the molded drain sump 32 substantially facilitates both the initial installation of the pool floor drain assembly of the present invention as well as installation related testing and subsequent maintenance. Transition element 46 by being integrally molded can as is illustrated in FIG. 4 produce a physically compact ninety degree bend to smoothly transition from a vertical orientation to a horizontal orientation to accommodate coupling with an external horizontally oriented water return line 16 buried in the ground. The configuration of this transition element allows it to be highly compact in both the horizontal and vertical directions such that the width of transition element 46 is contained well within the overall width of the pool floor drain assembly itself. With prior art cavity style pool floor drain assemblies, a series of pipe extensions interconnected with two forty-five degree transition elements is normally required to prevent undue water flow restriction through this comparatively high velocity fluid flow conduit. Particular pool floor drain assembly embodiments disclosed herein readily accomplish this ninety degree flow direction change within two inches of vertical distance whereas prior art techniques require from five to seven inches of vertical distance to accomplish that same direction change objective. For pool installations in rocky ground, caliche or other hard surfaces, this vertical distance reduction can represent a substantial savings in terms of installation cost and difficulty.

Because flow transition element 46 allows for vertical access from above through vertical oriented inlet 50 in adaptor 58, pool installation personnel can readily screw in fluid pressure testing equipment to perform leak testing before completion of pool construction. As illustrated in FIG. 4, funnel shaped drain body 64 can readily be inserted and removed because it is secured to drain sump 32 by a plurality of screws. This feature significantly facilitates both the original floor drain installation as well as subsequent maintenance and replacement of parts.

As illustrated in FIGS. 5 and 6, particular implementations of the bottom 34 of drain sump 32 may include an additional vertically oriented, threaded hydrostatic port 106 which is typically closed off with a threaded plug 108. Hydrostatic port 106 is designed to accommodate a hydrostatic valve 110 and a perforated french drain pipe 112 as shown in FIG. 9. Hydrostatic valves are required by codes in geographic areas such as Florida where the bottom of the pool may be installed below the local water table level. For such applications, plug 108 is removed to allow installation of a substitute hydrostatic valve 110 to perform the intended function of preventing the local water table from floating the pool out of the ground when a pool has been drained. When mouth or primary inlet 66 is obstructed, the secondary water flow path will be activated, preventing a significant pressure reduction within the secondary chamber and thereby also preventing unwanted activation of hydrostatic valve 110 with the resulting undesirable transfer of groundwater into the swimming pool. As a result, the unique configuration effectively isolates the static relief valve or hydrostatic valve 110 from the pool suction.

As shown in FIGS. 5 and 7, the domed top 76 further serves as a separately removable cover to access the hollow or open chamber formed within the interior of fluid deflecting plug 72 to allow service access to hydrostatic plug 108 and hydrostatic valve 110. The removal of top 76 does not compromise the safety characteristics of the drain because the sidewall of base 74 of fluid deflecting plug 72 remains in place even when the domed top 76 has been removed to allow service access to hydrostatic plug 108 or to hydrostatic valve 110.

As shown in FIG. 1, one or more vent slots 114 may be provided in domed top 76. Even if vacuum relief drain 28 or alternate water return line 30 become blocked, slots 114 will provide an alternate water flow path between fluid distribution chamber 102 and the pool to prevent the pool suction line from pulling the hydrostatic valve open and feeding ground water into the pool. When the pool has been drained and ground water forces the hydrostatic valve 110 open, ground water will flow into the empty pool through slots 114 even if other portions of the floor drain inlet have been blocked.

As shown in FIG. 4, the elongated fluid flow channel may be configured to include an appropriate length, spacing, and length to spacing ratio to restrict or prevent body appendages such as fingers or small hands from forming a sealing engagement with the suction inlet formed at neck 68. For example, a fluid flow channel length of about two inches or greater should accomplish that objective.

Optimum performance from a safety perspective may be achieved by forming the fluid flow channel with both a sufficient length and with a tapered, narrowing channel configuration as shown in FIG. 4.

It will be apparent to those skilled in the art that the disclosed swimming pool or spa floor drain assembly may be modified in numerous ways and may assume many embodiments other than the particular forms specifically set out and described above. For example, the transition from the relatively large diameter mouth of the floor drain assembly to the relatively small diameter neck of the funnel shaped drain body may be achieved by many other geometric configurations other than the parallel walled, double conical funnel configuration illustrated in the drawings. Specifically, the large diameter to small diameter transition could be made by means of various symmetric or asymmetric undulations transitioning from large diameter to small diameter or by a series of stepped diameter changes. In addition, it is not necessary that a constant spacing be maintained between the sidewalls forming the fluid flow pathway. In certain applications, it may be useful to vary the spacing between the sidewalls either by increasing the relative spacing, or by decreasing the relative spacing, both as a function of vertical position between the mouth and the neck of the system. Although particular embodiments of a pool floor drain assembly disclosed herein been described having a circular cross section, the cross section could equivalently and readily be fabricated in an oval, rectangular or serpentine configuration without any substantial loss in the advantageous functions described. For example, in a rectangular configuration, the opposed sidewalls of the funnel shared drain body and the fluid deflecting plug could be configured in a relatively parallel orientation along each rectangular sidewall segment. Embodiments of a pool floor drain assembly could also be configured in the shape of a polygon such as a hexagon in addition to the other shapes described above, and would be considered equivalent.

The flow bypass function described above in connection with the utilization of a plurality of circumferentially spaced apart slots 98 in combination with independent fluid chamber 102 could alternatively be configured as one or more apertures disposed at one or more locations in the sidewall of the funnel shaped drain body connected directly to alternate water return line 30 rather than providing for flow between an intermediate fluid distribution chamber 102.

In particular embodiments as shown in at least FIGS. 13-15, 17-19, 22, 27 and 28, suction line 18 may be formed oversized from that of the conventional size of pool suction lines. In such embodiments, the interior diameter 18A of a conduit of an additional, oversized, suction line 18 is sized to provide, as termed below, a low velocity water flow or a low velocity flow zone 627; a diameter of 4 inches would be representative in a particular embodiment. For example, in a particular embodiment, the size may be made sufficient to maintain a flow velocity of approximately 1.5 feet per second at 60 gallons per minute (GPM) rate and this velocity will remain essentially constant, or at least not exceed approximately 1.5 feet per second, to the junction of the suction line 18 with a much smaller and conventionally sized suction line 20. Within the conventionally sized suction line 20, the flow velocity may increase to 6 feet per second, as is normal in a conventional pool drain line to extend the flow velocity from the pump all the way to the sump, very close to the drain opening and potential swimmers. The total length of low velocity flow as shown below from either the slot 502 in the shroud 500 for the example of FIG. 22 or from the annular upper opening 610 in the cover 620 for the example of FIG. 25 to suction line 20 should be long enough to insure that any reasonable length of hair a swimmer may have or length of clothing used by a swimmer and that may be drawn into the sump will not reach suction line 20. Thereby, the "suction" acting upon such hair or clothing will be relatively low and withdrawal of same is readily accomplished. By experimentation, it has been learned that a low velocity zone of approximately 24 to 30 inches in length but at least a minimum of 16 inches, and in some cases at least a minimum of 18 inches, provides ample protection to prevent a bather from becoming entrapped at the grate.

Because the low velocity flow zone is included as a safety feature to reduce the likelihood that a swimmer's hair or clothing will be sucked into the drain far enough to reach the second suction line 20 with its higher flow velocity, the minimum length of the low velocity flow zone is intended as a minimum possible measurement from every location on the second end of the first suction line to every point on the drain opening so that no point on the drain opening is less than the minimum length from every point on the second end of the first suction line.

It is to be noted that each of the embodiments of the sumps or drain assemblies described herein is devoid of elements that might cause entanglement of long hair drawn into the sump through the slot. That is, neither the grate, the supporting frame, the cover, nor the housing have any protrusions or slots within the normal drain water flow path about which strands of hair may wrap and thereby become impossible or difficult to extricate.

Referring jointly to FIGS. 13, 14, 15, and 16, there is shown a cylindrical pool floor drain assembly 360. A cylindrical housing 362 supports boss 84 for discharging water into radially expanded suction line 18 and suction line 20. Bypass line 30 is connected via boss 86 to the housing. It is to be understood that housing 362, boss 86, boss 84 and necked down suction line 18 can be manufactured or assembled as a single unit for use in the field. A pipe 206, having apertures 208 for admitting ground water, extends from boss 204 located at the center bottom of housing 362; this pipe can be made as part of the housing also. An inflow of water, as represented by arrow 364 swirls about grate 366 and flows into circular slot 368. Slots 370 in cap 372 accommodate outflow of ground water into the pool.

Cylindrical sump 360 is intended for use with a liner pool. Hence, a representatively illustrated sheet 374 of vinyl is illustrated. It is to be understood that cylindrical sump 360, along with the attendant water lines, would be located in the dirt beneath the vinyl sheet if the liner pool is an in-ground pool.

Figure 13:
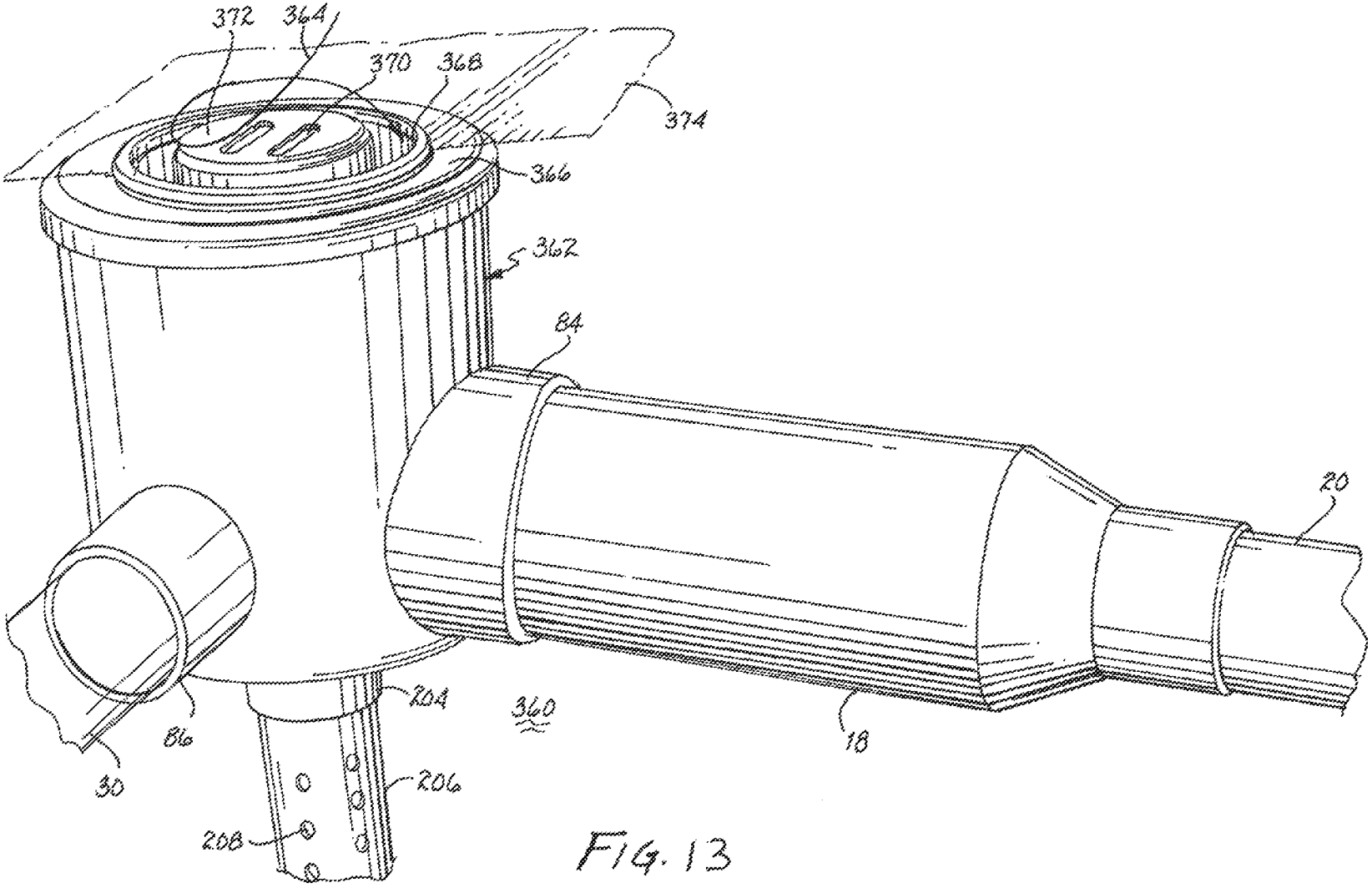
FIG. 13 illustrates a preformed cylindrical variant of a pool floor drain assembly.
Figure 14:
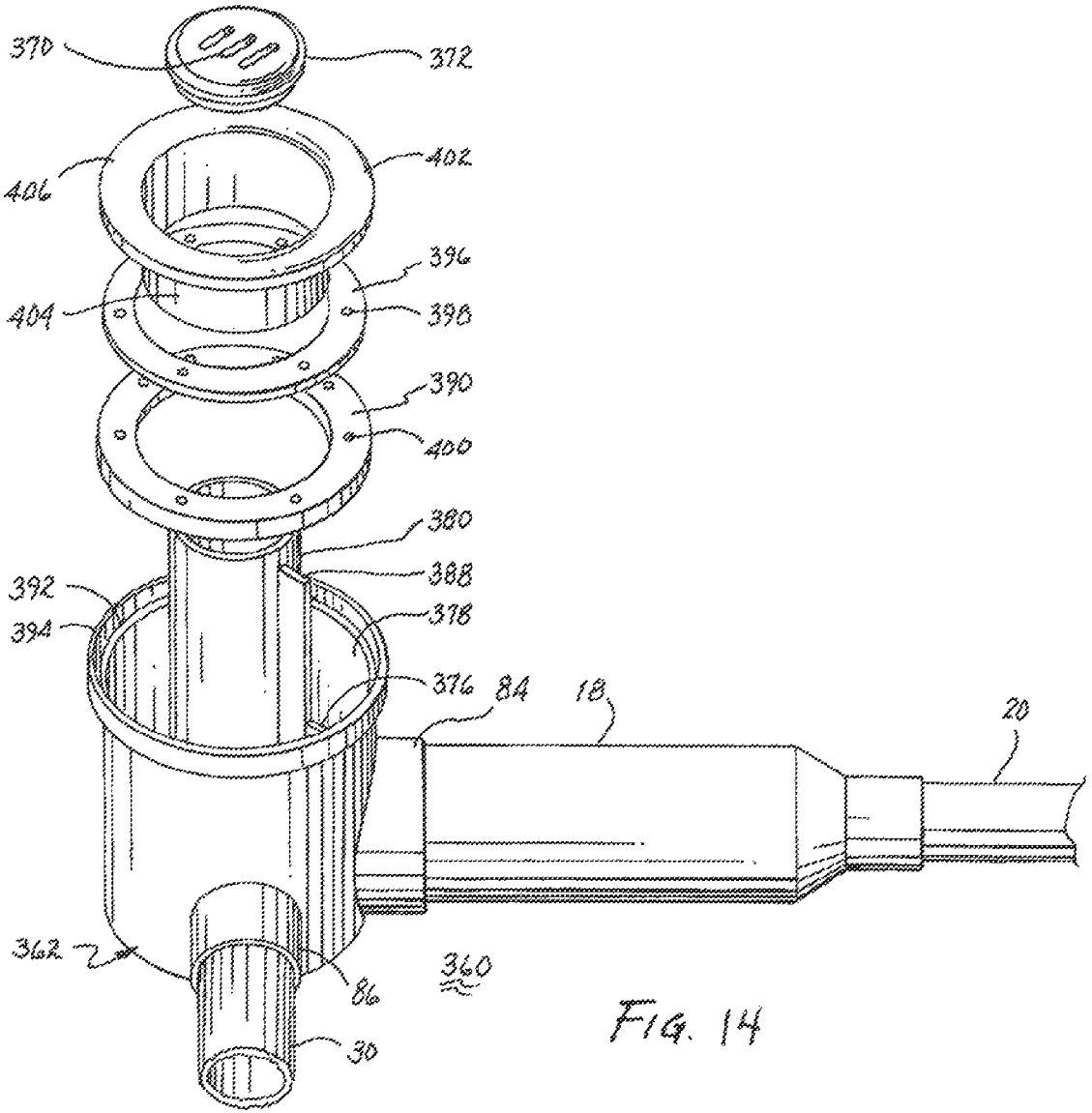
FIG. 14 is an exploded view of the pool floor drain assembly shown in FIG. 13.
Figure 15:
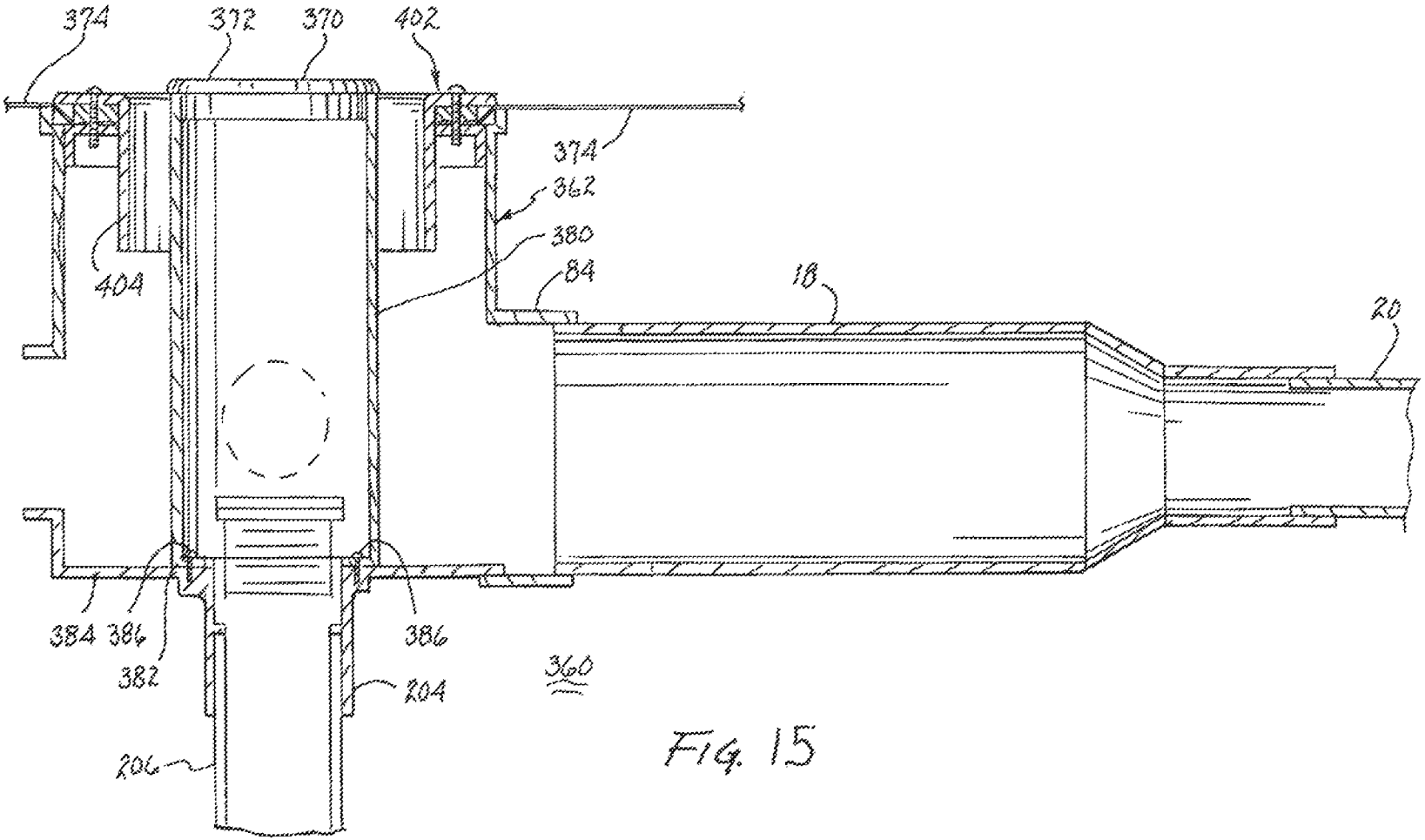
FIG. 15 represents a partial cross sectional view of the pool floor drain assembly shown in FIGS. 13 and 14, and FIGS. 15A and 15B illustrate attachment of a pool liner to the pool floor drain assembly.
Figure 15A:
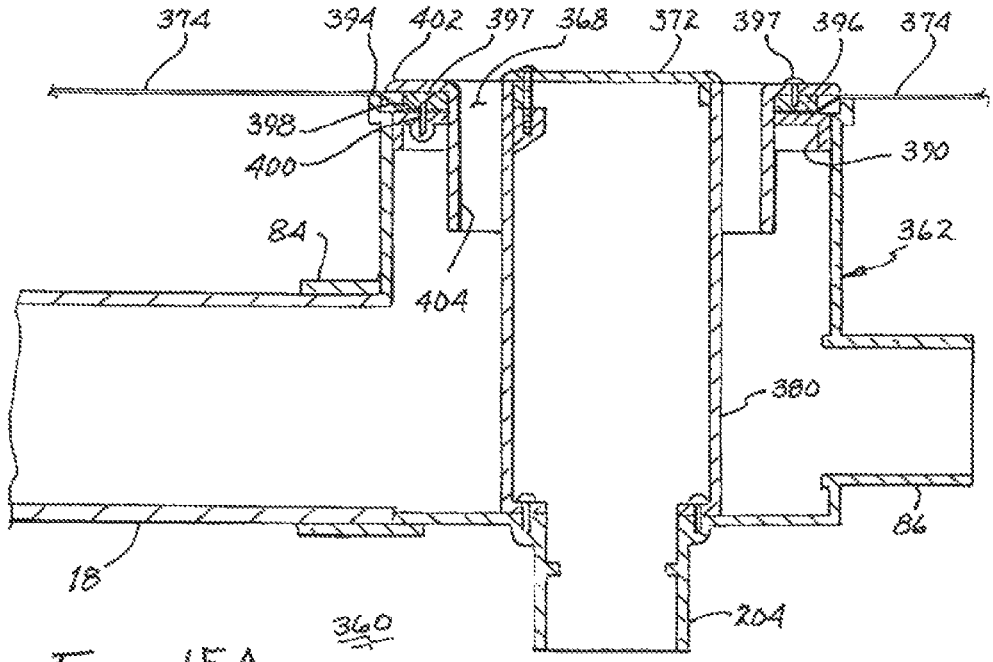
Figure 15B:
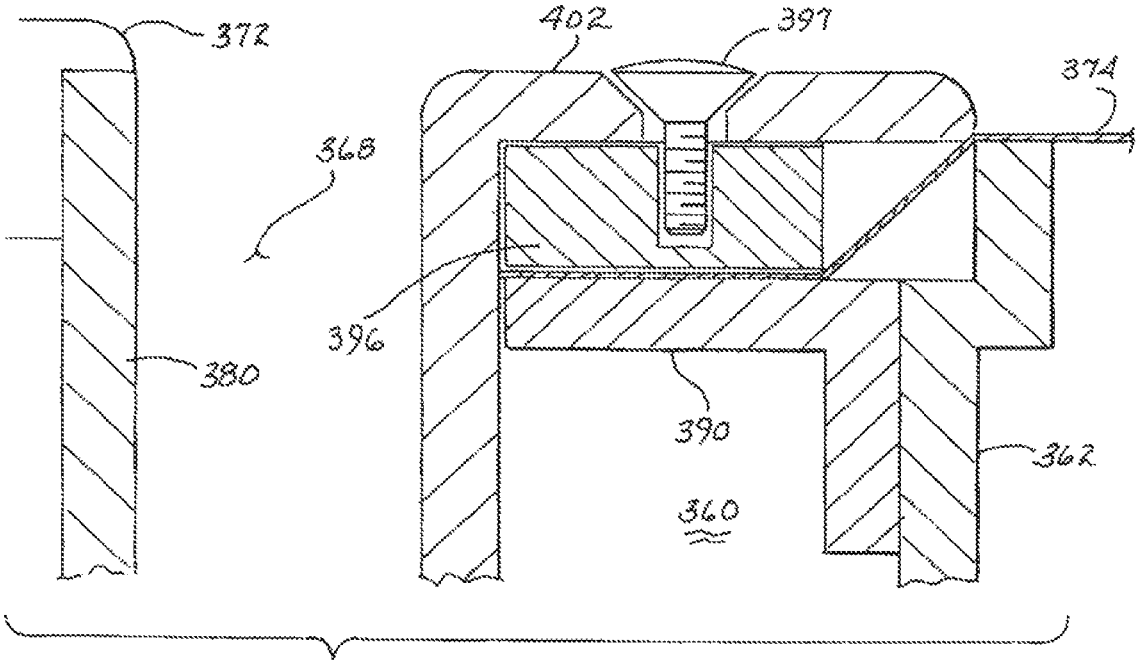
Figure 16:
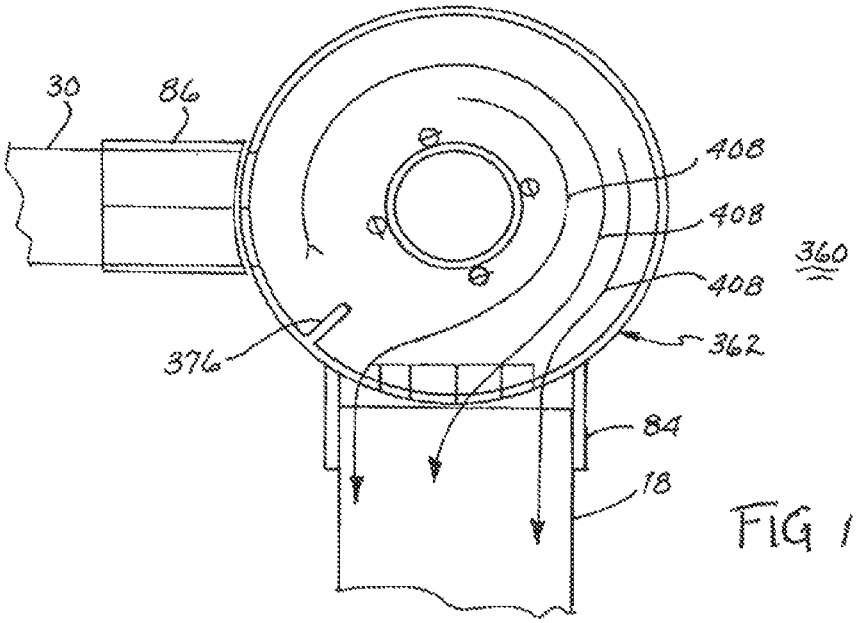
FIG. 16 illustrates the water flow within the pool floor drain assembly of FIG. 13.

The interior construction of cylindrical sump 360 will be described with reference primarily to FIGS. 14, 15, and 16. A vertical wall 376 extends radially inwardly from interior surface 378 of cylindrical housing 362. A cylinder 380 includes an interior circular flange 382 for attaching the cylinder to bottom 384 of the housing with screws 386 or the like. A vertical radially outwardly extending wall 388 extends from cylinder 380 into contacting engagement with the interior edge of wall 376. Thereby, circular flow about cylinder 380 is essentially precluded. It may be noted that the location of walls 376, 388 are intermediate bosses 84, 86 and their associated openings in the housing. Cap 372, and its associated slots 370, is in sealing engagement with the top of cylinder 380. A ring 390 rests upon circular ledge 392 disposed interior of housing 362 and below top edge 394 thereof. Alternatively, it may be secured to the interior surface of housing 362, as shown in FIGS. 15A and 15B. A further ring 396 is secured to ring 390 by screws 397 or the like penetrably engaging holes 398 in ring 396 and threadedly engaging holes 400 in ring 390. It is to be understood that vinyl sheet 374 (see FIGS. 13, 15A and 15B) is disposed intermediate these two rings and that the vinyl sheet is clamped in place by the rings. It may be noted that the elements of the clamps are interior to the external surface of housing 362. To ensure a sealed engagement with the liner, an annular gasket may be used in the conventional manner. After clamping, the portion of vinyl sheet interior of the rings is cut away.

A shroud 402 includes a circular skirt 404 depending from a ring element 406. Upon installation of shroud 402, the skirt defines an annular space between it and the exterior cylindrical surface of cylinder 380. The shroud may be secured in place by screws 397 as shown on the right in FIGS. 15A and 15B. Thereby, slot 368 illustrated in FIGS. 13, 15A and 15B is formed. As particularly shown in FIGS. 13 and 16, the suction present within boss 84 draws water from within housing 362. The flow path of this water is downwardly through slot 368 with most of the water being drawn through the slot counterclockwise from wall 376, as depicted by arrow 364 in FIG. 13 and arrows 408 shown in FIG. 16. Thereby, the flow rate demanded by suction pump 14 (see FIG. 10) is fully satisfied and little, if any, water will be drawn through boss 86 from bypass line 30 to satisfy the water flow demand present at the outlet to boss 84. However, should slot 368 be covered to a greater or lesser degree, sufficient low pressure would exist at the inlet to boss 86 to cause water to flow clockwise within housing 362 to satisfy the demand at the inlet to boss 84. As noted previously, in the event the liner pool is empty and the level of ground water approaches that of the bottom of the pool, the hydrostatic valve attendant boss 204 will open and ground water will flow through cylinder 380 and slots 370 in cap 372 and into the pool to prevent the pool from floating.

FIGS. 17, 18, 19, 20, and 21 illustrate a variant cylindrical sump 410. Elements common with previously described embodiments will be referenced with the same reference numerals. This cylindrical sump is also intended to be used with a liner pool, as indicated by vinyl sheet 374 in FIG. 20. Housing 412 includes a bottom 414 supporting an elbow 416 to which boss 84 is attached and an elbow 418 to which boss 86 is attached. Boss 204, attendant pipe 206 and a hydrostatic valve, also extends from bottom 414. Aperture 420 in bottom 414 is in fluid communication with elbow 416. Aperture 422 is in fluid communication with boss 204. Aperture 423 is in fluid communication with elbow 418. A vertically extending shroud 424 includes a cylindrical section 426 to define an annular space 428 intermediate the cylindrical section and interior surface 430 of housing 412. A further section 432 is coincident with a part of the edge of aperture 420. A still further section 434 is coincident with a part of the edge of aperture 422. A wall 436 extends from the junction of sections 432, 434 to surface 430 of housing 412. Thereby, any flow within housing 412 between aperture 420 and aperture 422 must be through annular space 428. The upper edge of housing 412 includes an radially extending circular lip 438 having a plurality of holes 440 spaced there along. A ring 442 is generally coincident with lip 438 and includes a plurality of holes 444. This ring is used to clamp the sheet of vinyl against lip 438; screws 446 may be used to penetrably engage holes 444 and threadedly engage holes 440 in the lip. An annular gasket may be used to ensure a sealed junction with the sheet of vinyl. As noted above, the vinyl sheet interior of ring 442 is cutaway.

Figure 17:
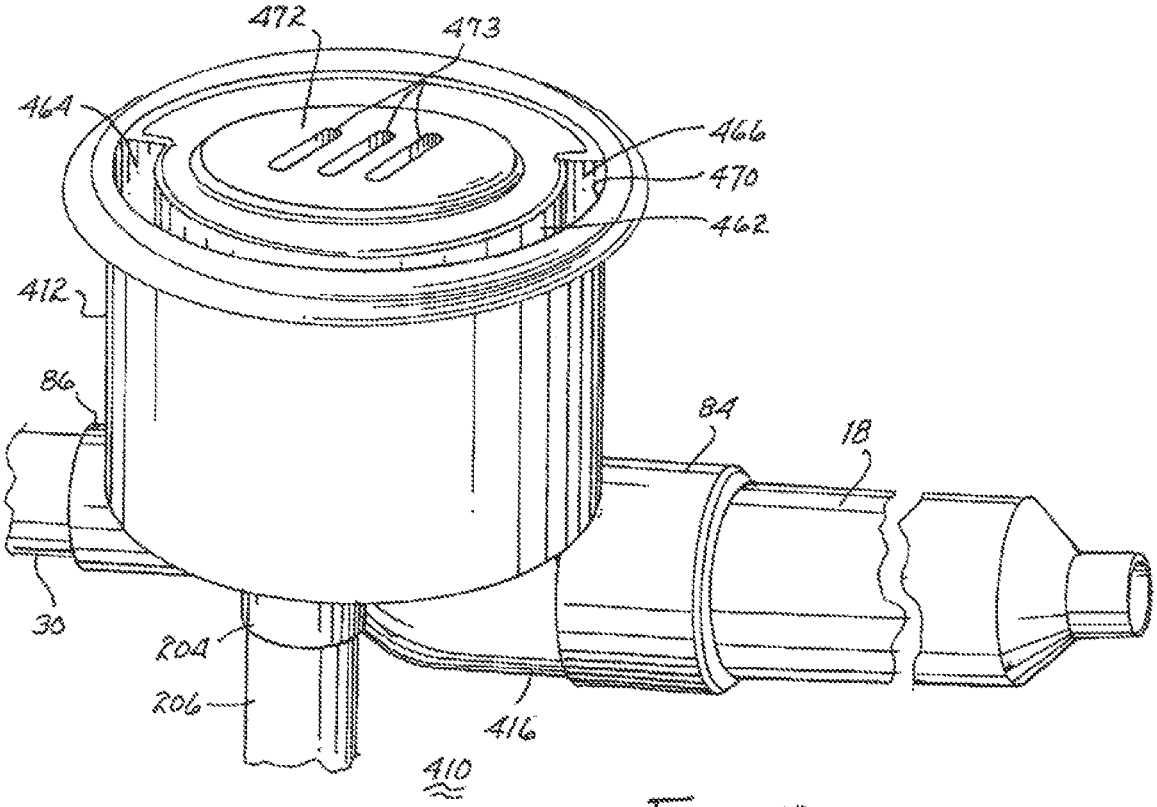
FIG. 17 illustrates a variant of a preformed cylindrical pool floor drain assembly adapted for use in a swimming pool having a liner.
Figure 18:
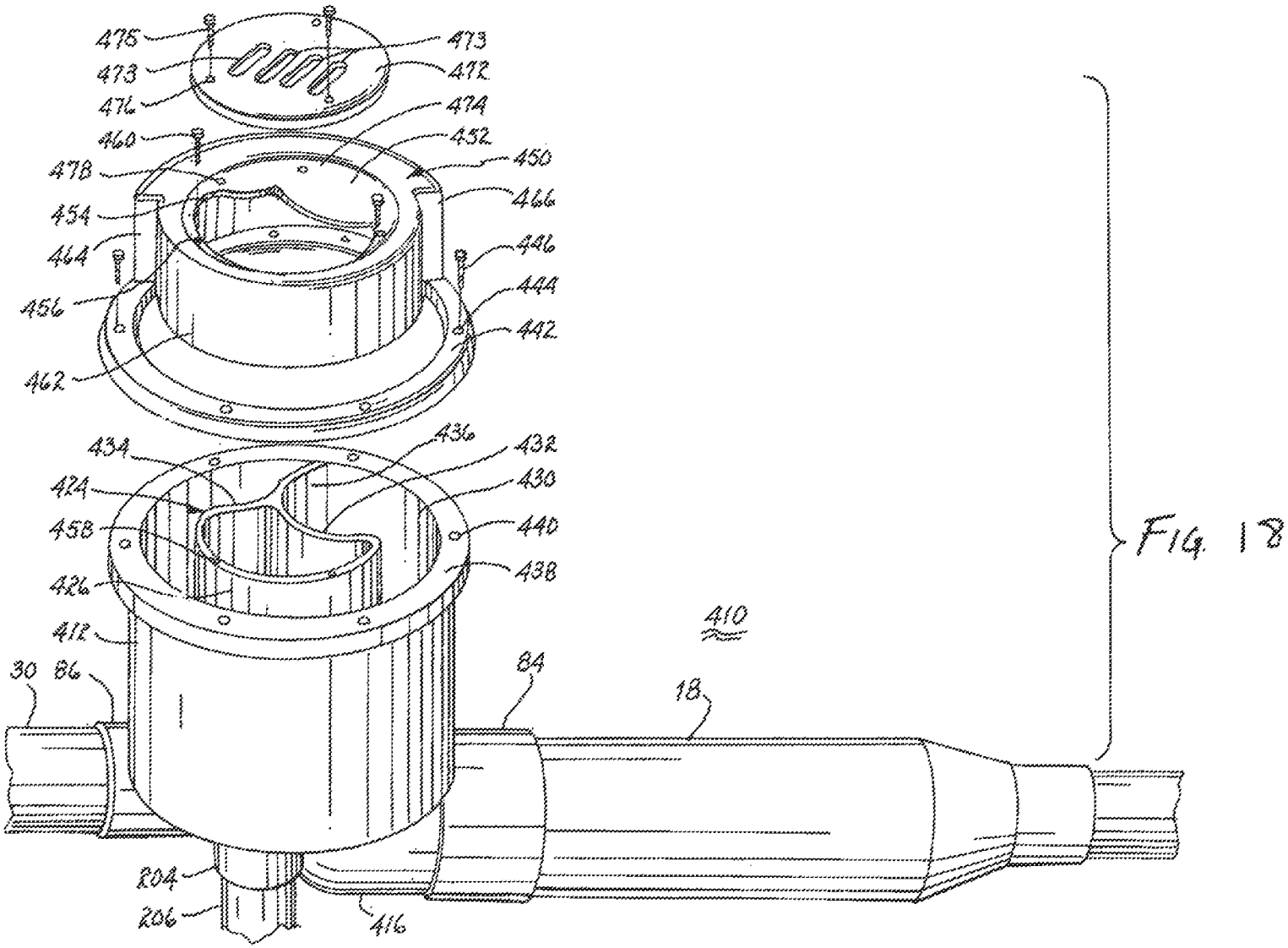
FIG. 18 is an exploded view of the pool floor drain assembly shown in FIG. 17.

A further shroud 450 includes a recessed apertured plate 452 having an aperture 454 generally coincident with the interior edges of sections 426, 432 and 434 of shroud 424. A plurality of holes 456 in plate 452 are coincident with each of a plurality of holes 458 formed in the top edge of shroud 424 to secure shroud 450 with shroud 424 by screws 460 penetrating the respective pairs of holes. Shroud 450 includes a first section of a cylindrical skirt 462 having a radius to place it radially outwardly of section 426 of shroud 424. Vertical walls 464, 466 are disposed at the terminal ends of skirt 462. Slot 470, as primarily depicted in FIG. 17, is formed by skirt 462, walls 464 and 466 and interior surface 430 of housing 412. Thus, slot 470 is formed by a plurality of separate but joined elements.

A cap 472 includes a plurality of slots 473. This cap is placed adjacent to plate 452 in the depression formed by downwardly extending cylindrical wall 474. The cap may be retained in place by screws 475 penetrably engaging holes 476 and threadedly engaging holes 477 in plate 452. In the event the hydrostatic valve associated with boss 204 is opened due to an empty pool and a rising ground water level, the water will flow upwardly through aperture 423 through shroud 424, aperture 454 in plate 452 and into the pool through slots 473. It may be noted that there is no intentional fluid communication between any water inflow through the hydrostatic valve and either of apertures 420, 422 in the bottom of housing 412.

Figure 19:
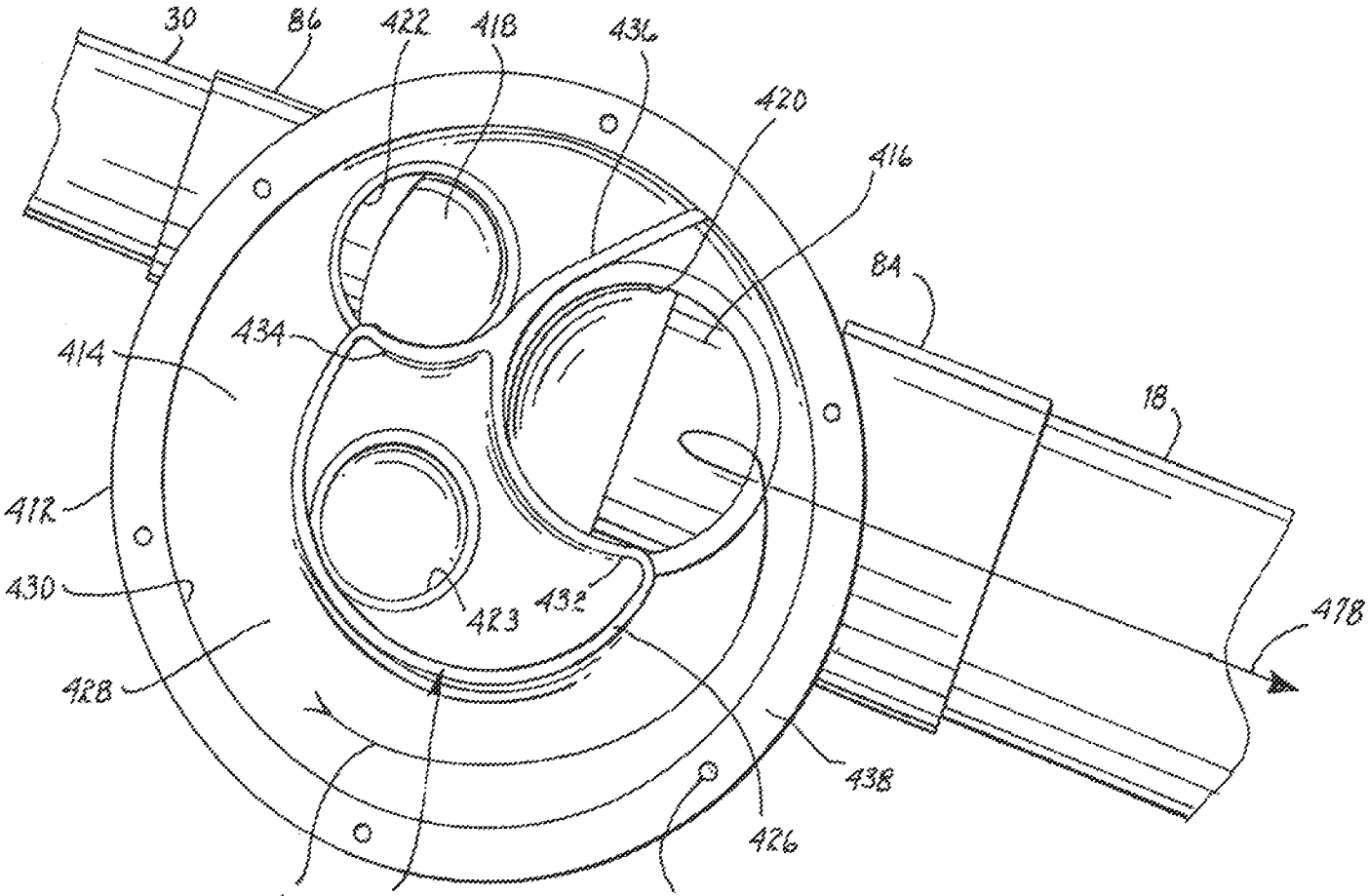
FIG. 19 illustrates the water flow in the pool floor drain assembly shown in FIG. 17.
Figure 20:
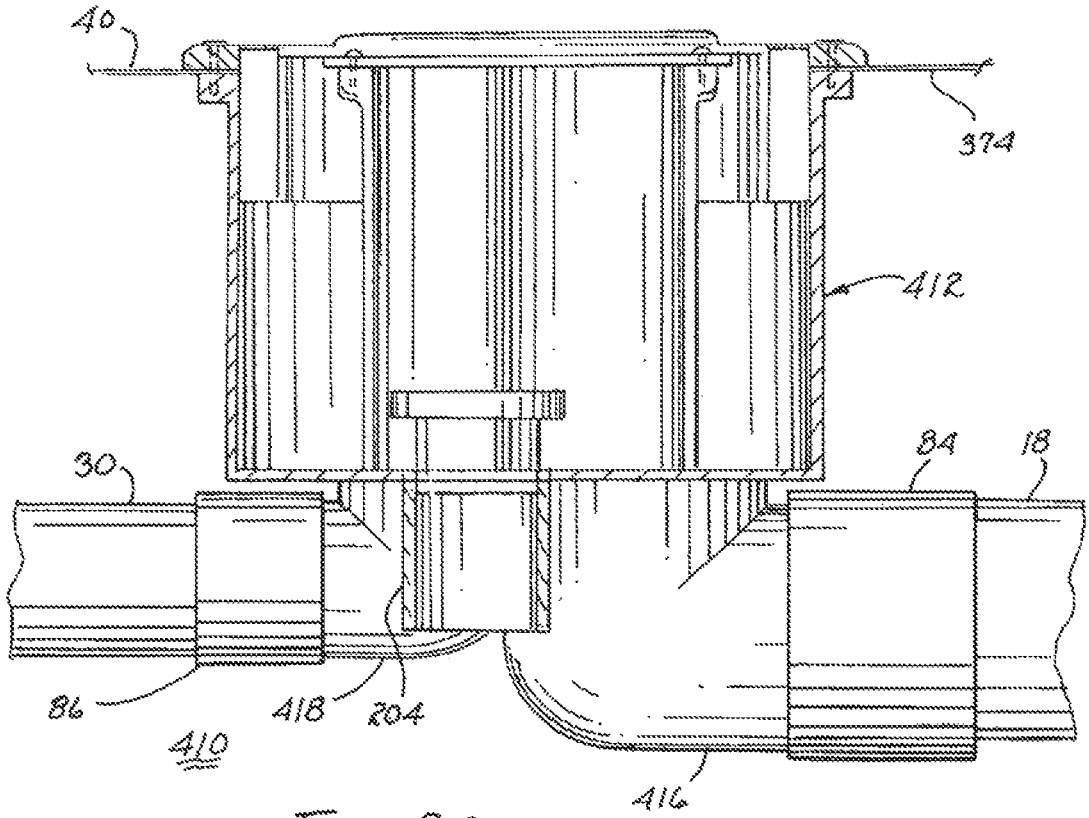
FIG. 20 is a side view of the pool floor drain assembly shown in FIG. 17.

As depicted by arrow 478 in FIG. 19, water will flow into slot 470 through annular space 428 and into elbow 416 through aperture 420. The primary draw for this waterflow will be toward the counterclockwise end of slot 470 as it is in closest proximity to aperture 420 and there will be little flow of water through aperture 422 into cylindrical sump 410 from bypass line 30.

Figure 21:
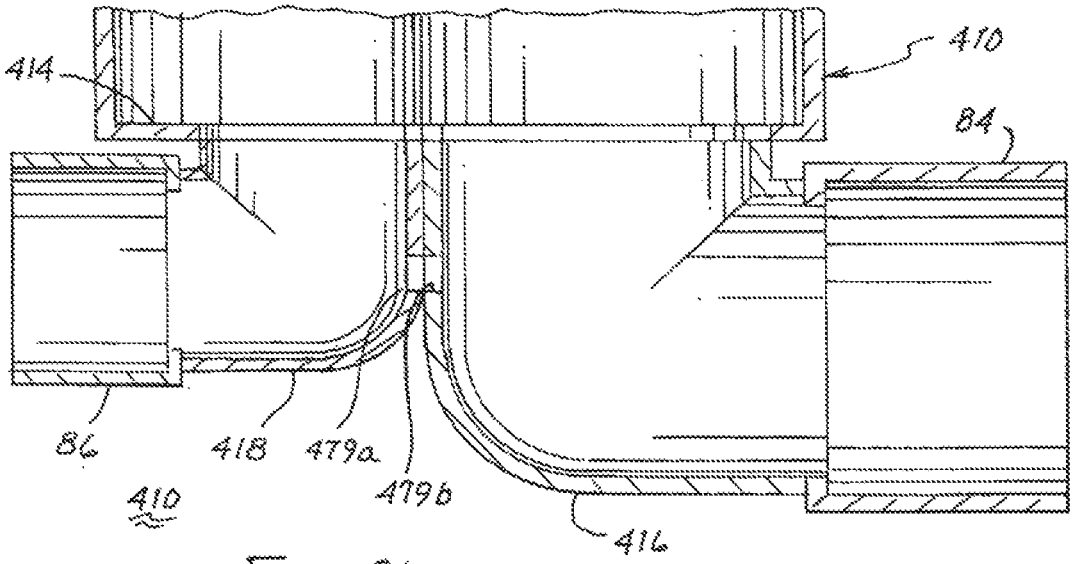
FIG. 21 illustrates waterflow relief between the inlet and outlet conduits attendant the pool floor drain assembly shown in FIG. 17.

As particularly illustrated in FIG. 21, elbows 416 and 418 are adjacent one another in contacting relationship. By forming apertures 479*a*, 479*b* at the point of contact, a limited amount of water flow there between will occur which will have no effect upon operation of the variant cylindrical sump. This water flow is used as part of the pressure test procedure prior to final installation to ensure that the plumbing attendant the sump is leak free. Thereby, a single pressure test can be made.

Figure 22:
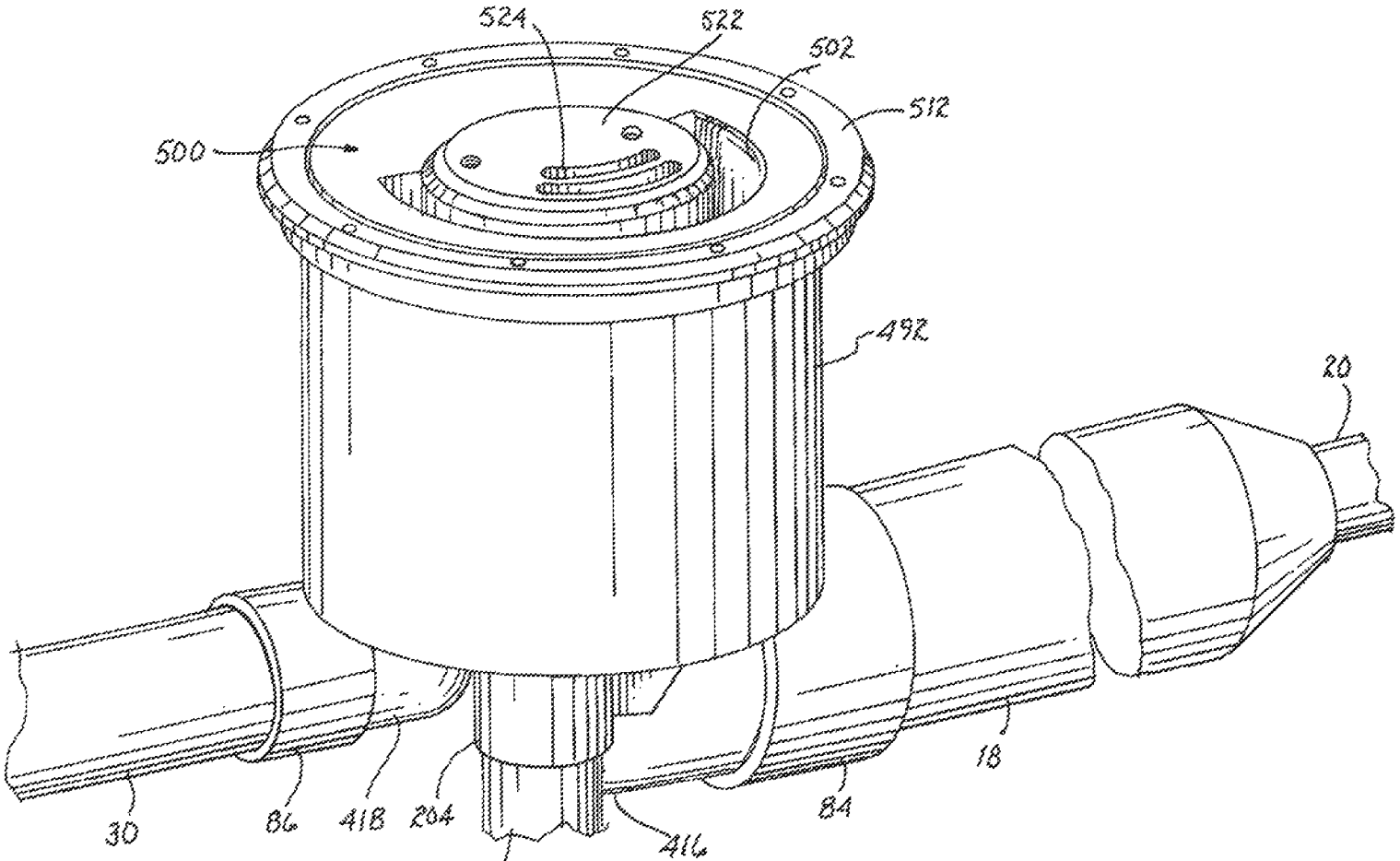
FIG. 22 illustrates another variant of a preformed cylindrical pool floor drain assembly adapted for use in a swimming pool having a liner.
Figure 23:
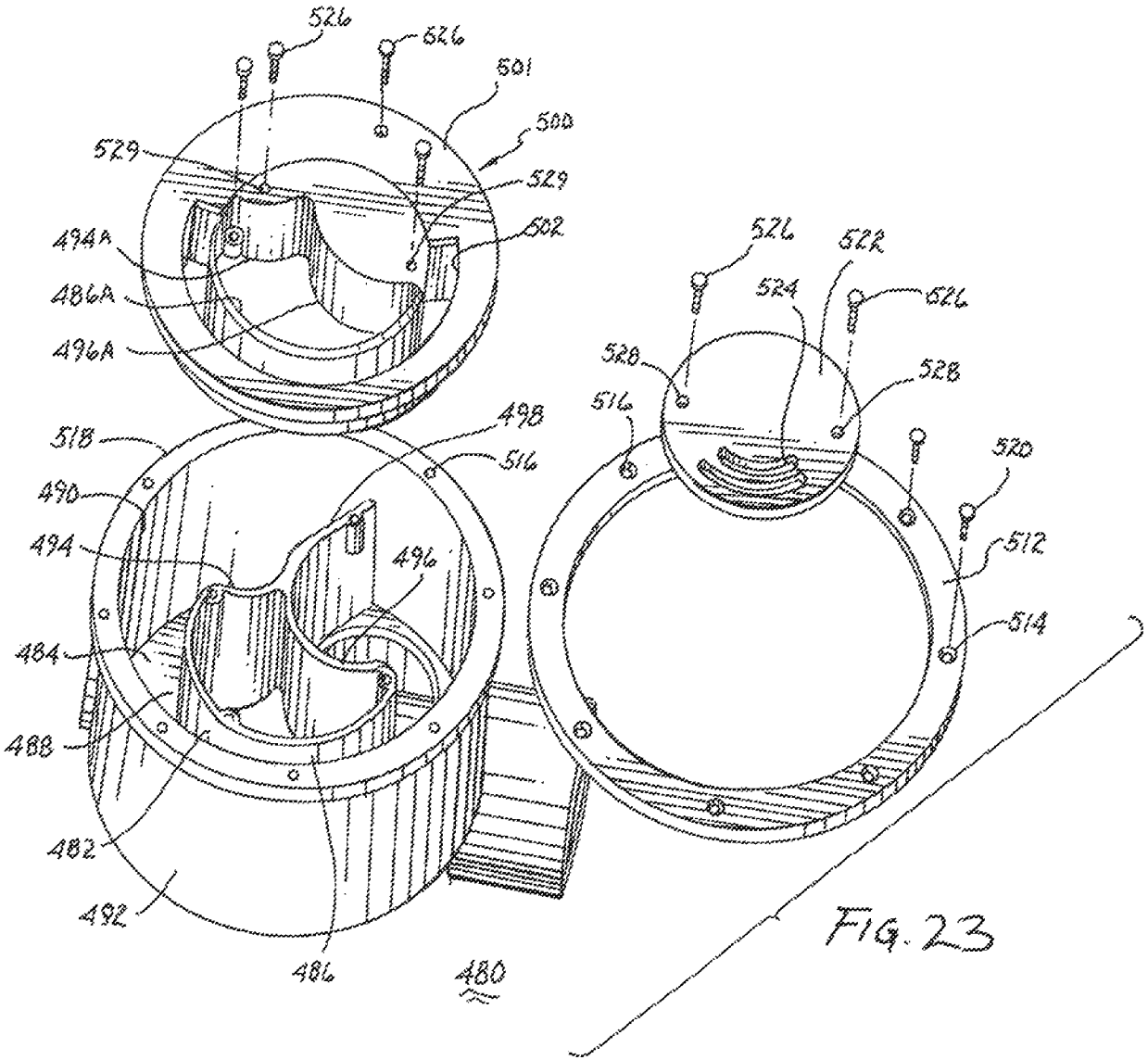
FIG. 23 is a partial exploded view of the pool floor drain assembly shown in FIG. 22.
Figure 24:
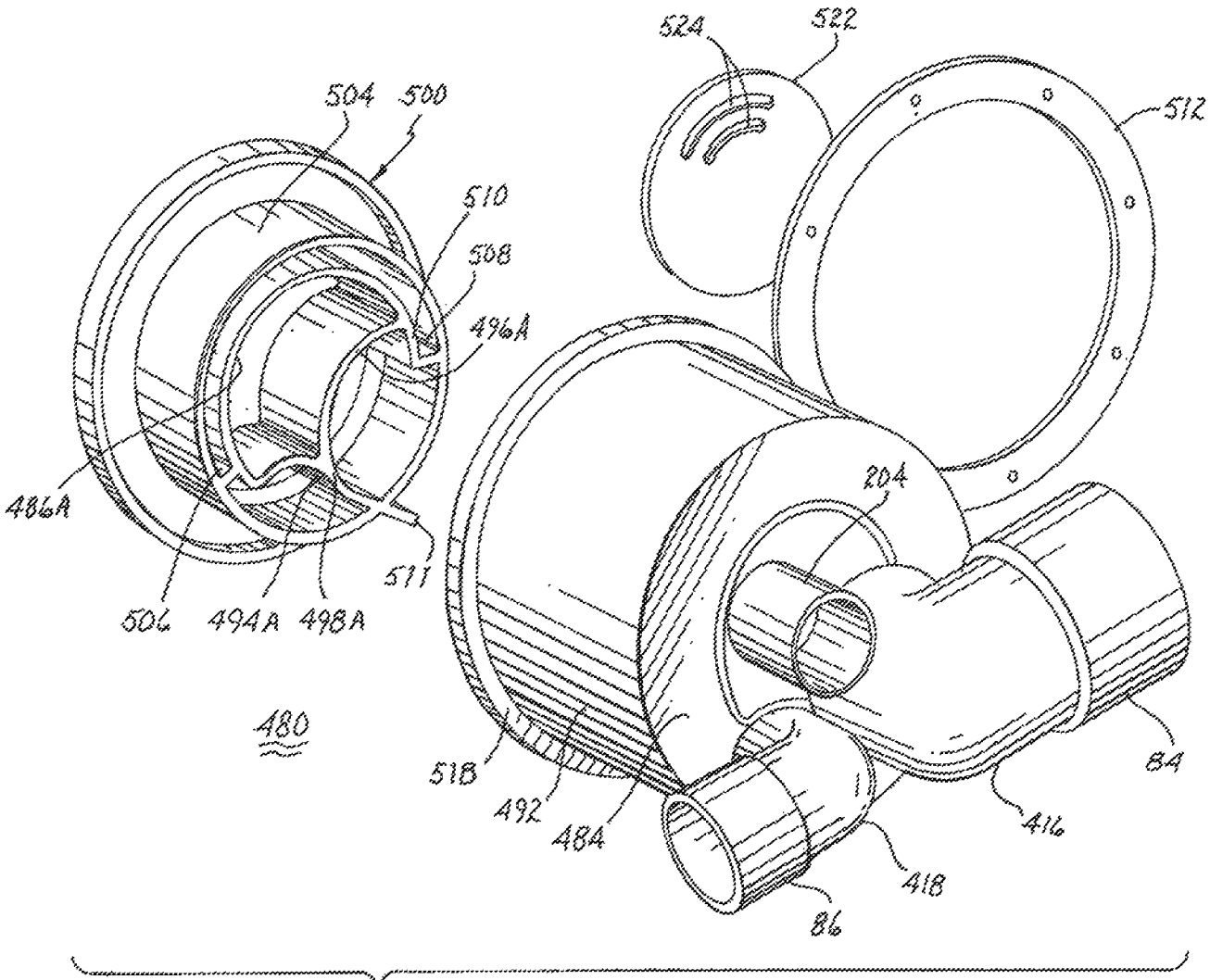
FIG. 24 is a further partial exploded view of the pool floor drain assembly shown in FIG. 22.

Referring jointly to FIGS. 22, 23 and 24, there is shown a variant cylindrical sump 480 which is quite similar to cylindrical sump 410 except that the internal shrouds are differently configured with certain other changes of elements. Because of such similarity, only the differences will be described in detail and common elements will have common reference numerals.

A shroud 482 is configured similarly to shroud 424 of sump 410 except that it extends only part way upwardly from bottom 484 of cylindrical housing 492. Shroud 482 includes a cylindrical section 486 that defines an annular space 488 with interior surface 490 of housing 492. Section 494 is partly coincident with the aperture in bottom 484 in fluid communication with elbow 418 and boss 86. Section 496 is partly coincident with the aperture in bottom 484 in fluid communication with elbow 416 and boss 84. A wall 498 interconnects the junction of sections 494 and 496 with interior surface 490 of housing 492. Shroud 500, as particularly shown in FIG. 24, includes a ring like plate 501 defining a slot 502 which is an arcuate section. A cylindrical shroud 504 extends from plate 500. It may be noted that the diameter of the plate measures less than the internal diameter of housing 492. A section 486A mates with section 486. Similarly, sections 494A and 496A mate with sections 496 and 494, respectively. Wall 498A mates with wall 498. A wall 506 interconnects shroud 504 and section 486A to define one end of slot 502. Similarly, a wall 508 interconnects with shroud 504 and an extension 510 of section 486A to define the other end of slot 502. A further wall 511 extends laterally from shroud 504 coincident with a corresponding part of wall 498 within housing 492.

As shown in FIG. 23, plate 501 includes an aperture defined by the top edges of sections 486A, 494A and 496A. A ring 512 includes a plurality of holes 514 mating with holes 516 in radially extending lip 518 of housing 492. A plurality of screws 520 secure ring 512 to lip 518 and the vinyl sheet disposed there between. Furthermore, ring 512 maintains shroud 500 in place as the ring includes a radially inwardly extending lip 513 for supporting the perimeter of the shroud. A cap 522 includes one or more slots 524 in fluid communication with the aperture defined by sections 486A, 498A and 496A. The cap may be secured to shroud 500 by screws 526 penetrably engaging holes 528 and threadedly engaging holes 529.

Figure 25:
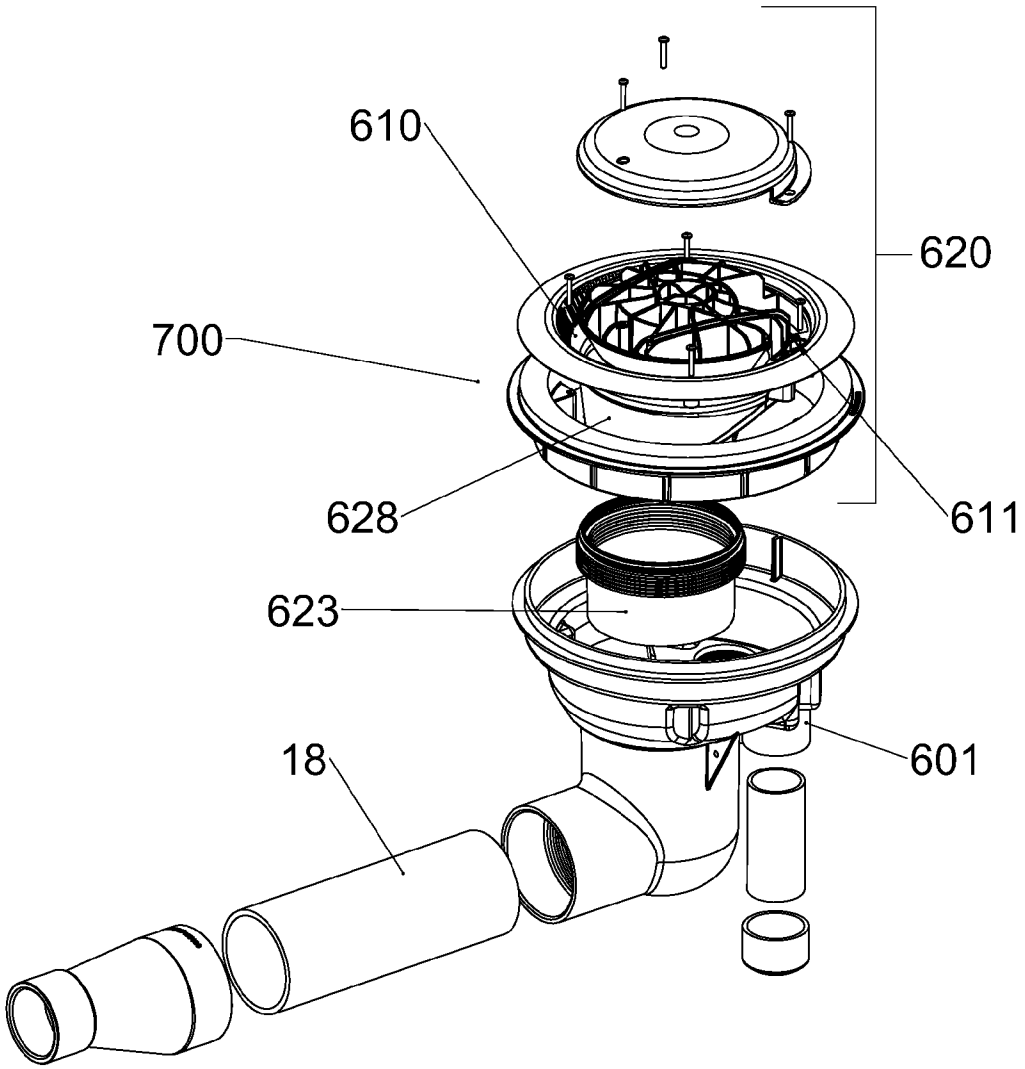
FIG. 25 is an exploded view of another cylindrical pool floor drain assembly.
Figure 26:
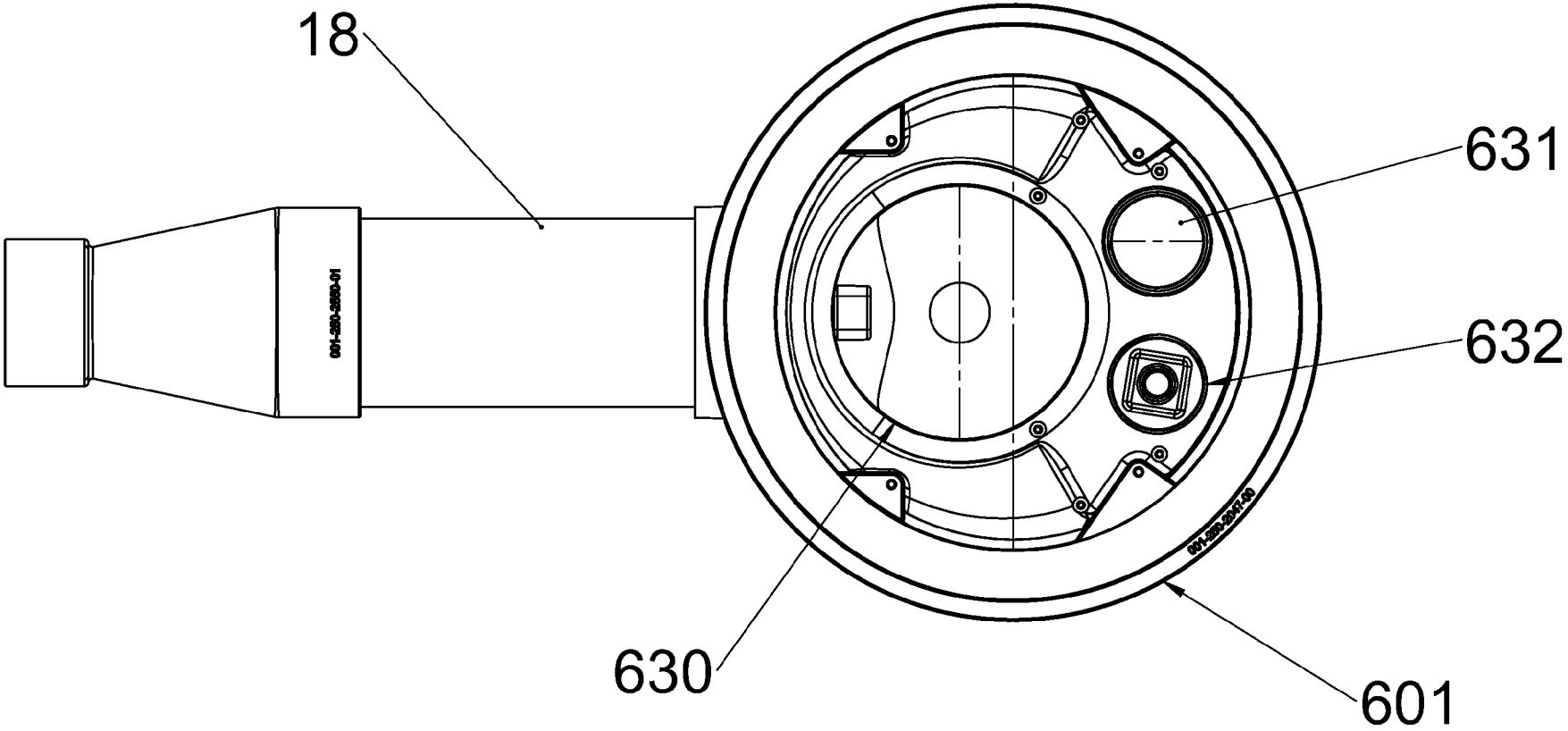
FIG. 26 is a top view of a drain body of the cylindrical drain assembly of FIG. 25.

Another variant of a cylindrical swimming pool floor drain assembly 700 is shown in an exploded view in FIG. 25. The embodiments of FIGS. 25-28 are similar to and include similar components to the embodiments of FIGS. 1-12, with several useful improvements including, but not limited to, an offset drain outlet and a low flow velocity zone comprising an enlarged suction element. With specific reference to FIG. 25, a drain cover 620 includes an annular upper opening 610 that serves as an inlet for pool water to flow to a fluid flow opening 630 near the middle of the drain body 601. This flow is typically driven by pool suction through a pump 14 (see FIG. 10, which layout applies to all of the Figures in this disclosure). The planar cross sectional area of the annular upper opening 610 and the planar cross section of the fluid flow opening 630 are substantially parallel to each other with the fluid flow opening 630 positioned below the annular upper opening 610 when the cover is installed on the cylindrical drain body 601. As used herein in relation to relative planar orientations of the annular upper opening 610 and the fluid flow opening 630, because they may have some variance due to the care and conditions of the orientation of the respective parts in the floor of the swimming pool, the term "substantially parallel" is intended to mean within 7 degrees of parallel as up to a 7 degree difference is conventionally tolerated during installation of swimming pool drains in swimming pool floors in relation to the pool floor. Although the drain body 601 is not entirely cylindrical, it is considered cylindrical for purposes of this disclosure because it is generally cylindrical in shape. Additionally, the fluid flow opening 630 and the annular upper opening 610 are non-concentric, meaning their center axes extending perpendicularly from their respective planar surfaces are not aligned and are offset one from the other. The positioning of the fluid flow opening 630 is non-concentric in relation to the annular upper opening 610 and has the benefit of reducing the space required on a pool floor for a safety drain assembly, and reduces the required material used for manufacturing a cylindrical drain assembly 700 such as that illustrated in FIGS. 25-28 as compared with earlier embodiments such as those illustrated in FIGS. 1-9 and conventional concentric pool drain assembly designs. This is because, among other reasons, conventional pool drain designs may use one or both of a return bypass line and a hydrostatic line. In conventional pool drain designs, the fluid flow opening (drain line opening) is concentric with the opening to the drain housing. Thus, the inclusion of one or both of the return bypass line and the hydrostatic line always enlarge the housing from its original size by twice the diameter of the larger of the return bypass line and the hydrostatic line to maintain the concentric positioning of the fluid flow opening. By positioning the fluid flow opening 630 non-concentrically with the annular upper opening 610, these additional lines, if they are included, do not require as large of a drain body 601 to accommodate the additional lines. FIG. 26 is a representation of top down view of the drain body 601 with the cover 620 removed. FIG. 26 illustrates the drain body top opening into which the cover 620, with its annular upper opening 610, is installed in a non-concentric position with respect to the fluid flow opening 630.

FIG. 25 also depicts a connector 623 that connects the cover sidewall 628 to the fluid flow opening 630. The connector 623 improves the connection between the cover sidewall 628 and the fluid flow opening 630 by allowing for adaptation between potential tolerance differences that may occur between the cover 620 and the drain body 601 as a result of manufacturing or installation variances. The connector 623 may be of various shapes and materials. A flexible or semi-rigid connector 623, including non-limiting various coupling or securing features, such a threading or compression fitting, is contemplated.

FIG. 26 also shows a second fluid flow opening 631 in the drain body 601 that is positioned below the annular upper opening 610 and is also non-concentric with the annular upper opening 610. This second fluid flow opening 631 could be either connected to a return line 30, to reduce the velocity flow through the drain body 601, or to a hydrostatic port. The relative positioning of the second fluid flow opening 631 and the fluid flow opening 630 depicted in FIG. 26 illustrates that the longitudinal axes of both the fluid flow opening 630 and the second fluid flow opening 631 are substantially parallel to each other. The locations of the fluid flow opening 630 and the second fluid flow opening 631 in FIG. 26 with respect to one another are not intended to be limiting, and other locations within the drain body 601 are contemplated.

Figure 27:
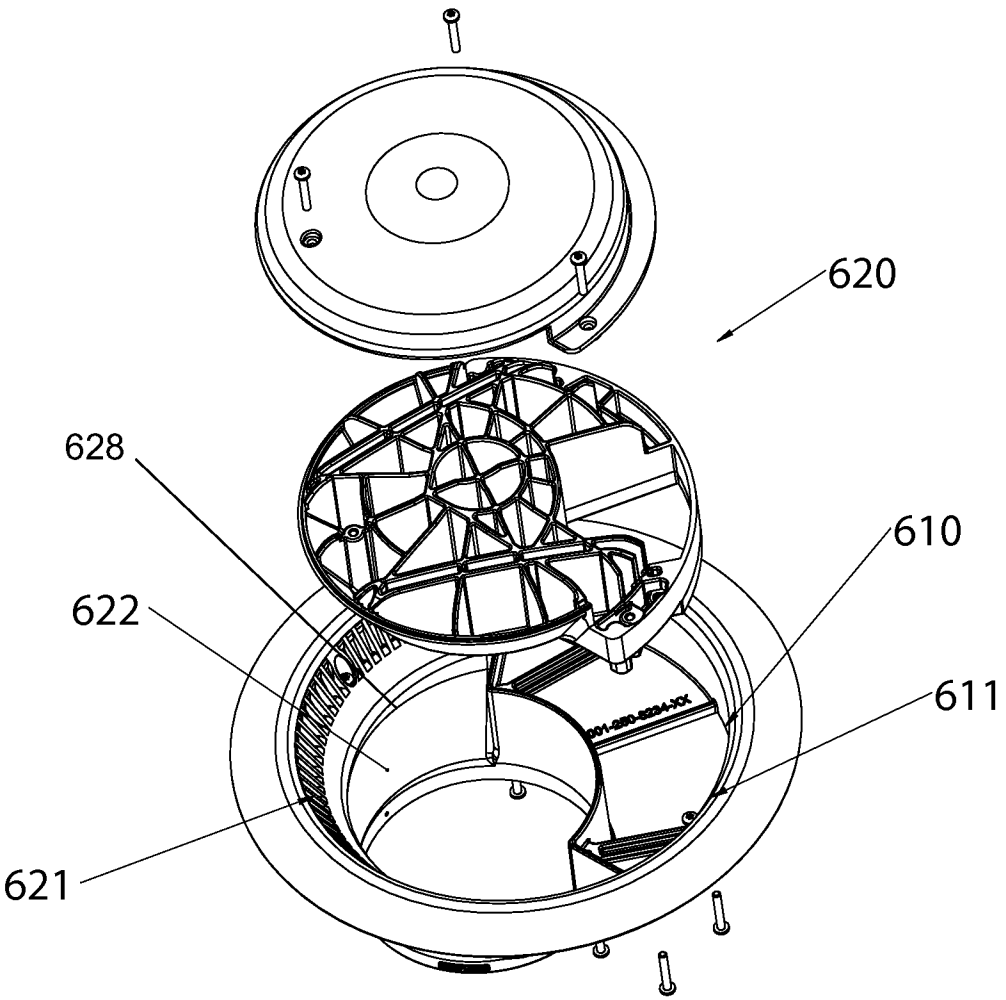
FIG. 27 is an exploded view of a cover of the cylindrical drain assembly in FIG. 25.
Figure 28:
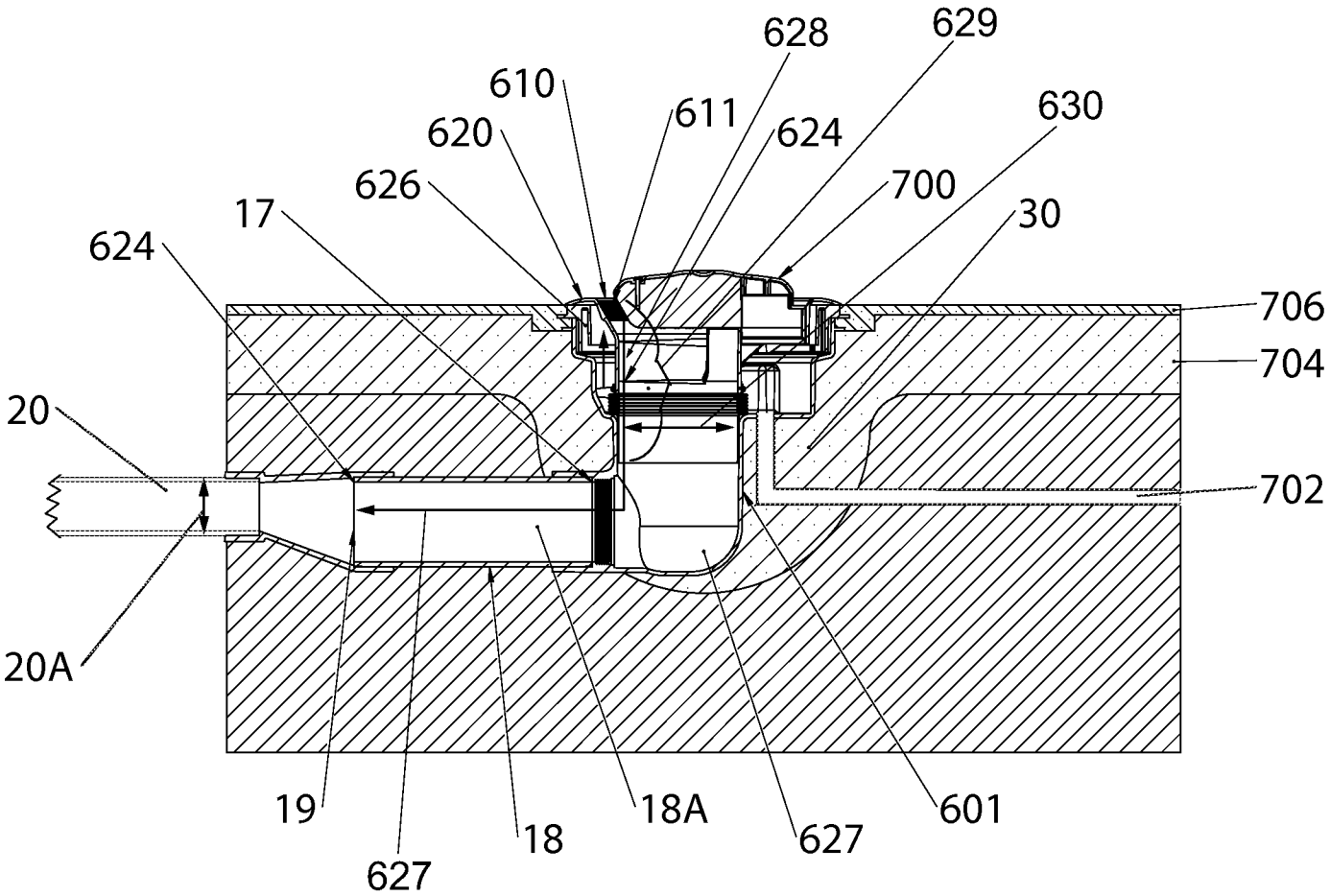
FIG. 28 is a cross sectional view of a cylindrical drain assembly.

FIG. 27 shows an exploded view of a representation of a cover 620 for the drain body 601. The cover 620 includes at least one cover opening 610 through the cover 620 that allows fluid flow through the cover 620 and its annular upper opening 610 to the drain body 601 (FIG. 28). The cover 620 may also include a sidewall 628 (FIG. 28) between the annular upper opening 610 and the fluid flow opening 630. This sidewall 628 defines a fluid flow channel 629 that extends between the annular upper opening 610 and the fluid flow opening 630 (FIG. 28). The design of the sidewall 628 that extends from the annular upper opening 610 to the fluid flow opening 630 may be angled, funneled, stepped, straight or other design and is not limited to the representation in FIG. 27. The drain cover 620 may be coupled to the drain body 601 through a compression fit, an adhesive, by a mechanical device or other securing mechanism, such as a screw or pin, and is not limited to the representations in FIGS. 25 and 28.

FIG. 27 provides other possible features of a sidewall 628 of the cover 620 including differences between the upper 621 and lower 622 portions of the side wall 628. The upper portion 621 of the sidewall 628 adjacent the annular upper opening 610 is vented, comprising at least one aperture, and the lower portion 622 that extends to the fluid flow opening 630 of the drain body 601 (FIG. 25) is not. In particular implementations, the flower portion 622 extends to the fluid flow opening 630 through the flexible or semi-rigid connecter 623, but in all cases it extends to the fluid flow opening 630 to ensure that the vast majority of the drain water flow follows the fluid flow channel 629 through the drain body 601.

As illustrated in the cross-sectional view of FIG. 28, the sidewall 628 extending from the annular upper opening 610 to the fluid flow opening 630 leaves the second fluid flow opening 631 on one side of the sidewall 628 and the fluid flow opening 630 on the other side. Separation of the fluid flow opening 630 from the second fluid flow opening 631 by the sidewall 628 restricts fluid flow between the second fluid flow opening 631 and the fluid flow opening 630 except through the vented upper portion 621 of the sidewall 628. Although the vented upper portion 621 of the sidewall 628 is illustrated as a series of slots, it should be understood that the vented upper portion 621 needs only one or more openings to be vented. Like with the embodiment shown and described with reference to FIGS. 1-5, the second fluid flow opening 631 coupled to a return line acts as a pressure release line. If a swimmer becomes trapped upon or the annular upper opening 610 of the drain assembly becomes blocked, the conventional suction pressure felt by the swimmer will be significantly reduced because water will flow in from the second fluid flow opening 631, through the vented upper portion 621 and through the fluid flow opening 630.

Returning to FIG. 26, the top view of drain body 601 also shows a representation of a third fluid flow opening 632. The third fluid flow opening 632 has a longitudinal axis, perpendicular to its cross-sectional area, which is substantially parallel to the longitudinal axis of the second fluid flow opening 631, and is therefore substantially parallel to the longitudinal axis of the fluid flow opening 630. In this configuration, the third fluid flow opening 632 may be a hydrostatic inlet coupled to a hydrostatic line and the second fluid flow opening 631 may be coupled to a return bypass line 30. Hydrostatic valves are generally used to prevent floatation of a pool structure when a pool is drained for service or the like. In some cases, a hydrostatic line and no return bypass line is used, in some cases a return bypass line and no hydrostatic line is used and in some cases both a hydrostatic line and a return bypass line are used.

FIG. 28 is a cross-sectional view showing various elements of drain assembly 700 installed in the ground 702. Cement 704 is placed around the drain assembly 700 after the drain assembly 700 is installed, and a plaster surface 706 is laid to finish off the assembly. Similar to the embodiments described with reference to at least FIGS. 17, 18, 19 and 22, a first, enlarged suction element 18 with a first open end 17 is connected to the fluid flow opening 630 of the drain body 601 before the second, conventionally sized suction line 20 is coupled to the system. The second open end 19 of the first suction line 18 is connected to a second suction line 20. Although it is illustrated here as a single, first suction line separate from the drain body 601, it should be understood that the first suction line 18 may be configured as one or more suction lines or as an extension of the drain body. If configured as multiple suction lines, they should be treated as a single, first suction line, when calculating distance and making other water flow velocity calculations if each of the suction lines meet the characteristics described herein. In an implementation where the flow velocity within the second suction line is approximately 6 feet per second, and the flow velocity within the first suction line is approximately 1.5 feet per second, the first suction line 18 has a diameter 18A that is at least approximately 25% larger than the diameter 20A of the second suction line 20. As an example, if the second suction line 20 had a diameter of 2 inches, the first suction line 18 would be at least 2.5 inches. This allows the first suction line 18 in particular implementations to be much larger, for example the first suction line 18 diameter 18A could be 4 inches or more while the second suction line 20 diameter 20A remains only 2 inches. This enlarged first suction line 18 provides part of the low flow velocity zone 627. The fluid flow opening 630 may include various additional components coupled thereto that permit coupling between the fluid flow opening 630 of the drain body 601 and the first suction line 18, such as a 90 degree turn elbow or other coupling. Additionally, both the first suction line 18 and the second suction line 20 may be conduit, pipe or some other liquid transporting enclosed body made of various materials and is not limited by the embodiment represented in FIG. 28.

The cross section view of FIG. 28 also depicts a representation of a low velocity flow zone 627 which includes the volume within the water flow channel from the top perimeter 611 (FIGS. 25 and 27) of the annular upper opening 610 to the second open end 19 of the first suction line 18. The low velocity flow zone extends outward from the top perimeter 611, meaning that the low velocity flow zone is not merely directly below the footprint of the top perimeter 611 but extends outside the footprint and extends beyond the top perimeter 611. The flow velocity within the first suction line 18, for the implementation where the flow velocity within the second suction line 20 is approximately 6 feet per second and the flow velocity within the first suction line 18 is approximately 1.5 feet per second, would be approximately 25% of the flow velocity of the second suction line 20. Additionally, the flow velocity within the entire low velocity flow zone 627 is approximately equal to or less than the flow velocity only through the first suction line 18. This contemplates potential small differences in the flow velocity throughout the entire low velocity flow zone particularly including potential minor differences in fluid flow between the first suction line 18 and fluid flow within the drain body 601. The fluid flow velocity within the first suction line 18 may be slightly higher than the fluid flow velocity within the drain body and therefore the velocity flow in the entire low velocity flow zone 627 is approximately equal to or less than the fluid flow velocity within just the first suction line 18.

FIG. 28 also depicts an additional potential implementation element of a drain assembly 700 with a low velocity flow zone 627 before the transition from a first diameter 18A of a first suction line 18 to a smaller second diameter 20A of a second suction line 20. A low velocity flow zone 627 of a minimum specified length provides more safety to swimmers with long hair or loose clothing than conventional pool drain assemblies. A minimum specified length of a low velocity flow zone 627 is defined such that no single point on the top perimeter 611 of the cover 620 to the second open end 19 of the first suction line 18 is less than a minimum linear measurement 624 along the fluid flow path from the top perimeter 611 to the second end 19 of the first suction line 18. In particular implementations, this minimum linear measurement 624 is at least about sixteen inches along a fluid flow path. Other implementations of minimum linear measurements for low velocity flow zones are described elsewhere herein. As the linear measurement 624 represented in FIG. 28 shows, fluid flowing as directly as possible from the perimeter 611 of the annular upper opening 610 to the second end 19 of the first suction line 18 would travel along a linear path as limited by the design features of the drain assembly 700. Because the low velocity flow zone is included within the design as a safety feature to reduce the likelihood that a swimmer's hair or clothing will be sucked into the drain far enough to reach the second suction line 20 with its higher flow velocity, the minimum linear measurement is intended as a minimum possible measurement from every location on the second end of the first suction line to every point on the perimeter 611 of the annular opening 610.

Accordingly, it is intended by the appended claims to cover all such modifications of the invention which fall within the true spirit and scope of the invention.

The invention claimed is:

1. A drain assembly for installation in a floor of a pool, the drain assembly comprising:

a cover comprising at least one opening therethrough defining an annular upper opening with a planar cross-sectional area, the annular upper opening serving as a fluid flow inlet from a swimming pool to a pump, the cover further comprising a fluid deflecting plug supported within the annular upper opening from a side of the cover such that a majority of the fluid deflecting plug is suspended within the annular upper opening and spaced apart from the cover to define an opening to a fluid flow channel through the cover; and a cylindrical drain body comprising a fluid flow opening with a planar cross-sectional area positioned below and substantially parallel to the annular upper opening cross-sectional area when the cover is coupled to the drain body, wherein the fluid flow opening and the upper opening are non-concentric.

2. The drain assembly of claim 1, wherein the cover further comprises a sidewall between the annular upper opening and the fluid flow opening, the sidewall defining a fluid flow channel extending between the annular upper opening and the fluid flow opening.

3. The drain assembly of claim 1, wherein the drain body includes a second fluid flow opening positioned below the annular upper opening, wherein the second fluid flow opening and the upper opening are non-concentric.

4. The drain assembly of claim 3, the annular upper opening comprising a longitudinal axis perpendicular to its planar cross-sectional area and the second fluid flow opening comprising a longitudinal axis, wherein the longitudinal axis of the annular upper opening and the longitudinal axis of the second fluid flow opening are substantially parallel to each other.

5. The drain assembly of claim 4, wherein the second opening is one of a return line and a hydrostatic inlet.

6. The drain assembly of claim 4, wherein the sidewall comprises an upper vented portion adjacent the upper opening and a lower non-vented portion such that the second fluid flow opening is positioned on a first side of the lower non-vented portion of the sidewall and the fluid flow opening is positioned on a second side of the lower non-vented sidewall separated from the first side such that the second fluid flow opening is separate from the fluid flow channel defined by the sidewall and is substantially not in fluid communication with the fluid flow opening except through the upper vented portion of the sidewall.

7. The drain assembly of claim 4, wherein the drain body further comprises a third fluid flow opening positioned below and non-concentric with the annular upper opening, the third fluid flow opening comprising a longitudinal axis, and wherein the longitudinal axis of the third fluid flow opening is substantially parallel to the longitudinal axis of the annular upper opening and to the longitudinal axis of the second fluid flow opening.

8. The drain assembly of claim 7, wherein the second opening is a return bypass line and the third opening is a hydrostatic inlet.

9. The drain assembly of claim 6, further comprising a connector coupled between the cover sidewall and the fluid flow opening and securing the fluid flow channel from the sidewall to the fluid flow opening.

10. The drain assembly of claim 1, further comprising a first suction line comprising an enclosed body with a first open end coupled to the fluid flow opening and a second open end coupled to a first open end of a second suction line further comprising an enclosed body with a second open end, wherein the first suction line comprising a diameter at least 25% larger than a diameter of the second suction line.

11. The drain assembly of claim 1, further comprising a low velocity flow zone comprising a volumetric flow extending from a top perimeter of the annular upper opening to the second end of the first suction line such that a flow velocity through the second suction line is at least four times greater than the flow velocity within the first suction line and the flow velocity throughout the low velocity flow zone maintains a flow velocity approximately equal to or less than the flow velocity within the first suction line.

12. A drain assembly for installation in a floor of a pool, the drain assembly comprising:

a cover defining an annular upper opening with a planar cross-sectional area, the upper opening serving as a fluid flow inlet from a swimming pool to a drain;

a drain body comprising an annular fluid flow opening with a planar cross-sectional area positioned below and substantially parallel to the annular upper opening, wherein the drain outlet and the upper opening are non-concentric;

wherein the cover comprises a sidewall comprising an upper vented portion adjacent to the annular upper opening and a lower non-vented portion defining a fluid flow channel extending from the annular upper opening to the fluid flow opening of the drain body;

a first suction line, comprising a first diameter, coupled to the drain body at a first end of the first suction line and coupled to a second suction line at a second end of the first suction line opposite the first end, the second suction line comprising a second diameter smaller than the first diameter of the first suction line and wherein, every point on the top perimeter of the annular upper opening is at least about 16 inches from the second end of the first suction line when measured linearly along a fluid flow path from each respective point on the top perimeter of the annular upper opening to the second end of the first suction line; and a low velocity flow zone comprising a volumetric flow extending from the top perimeter of the annular upper opening to the second end of the first suction line such that a flow velocity through the first suction line is at least approximately 25% of the flow velocity within the second suction line and the flow velocity throughout the low velocity flow zone maintains a flow velocity approximately equal to or less than the flow velocity within the first suction line;

wherein the low velocity flow zone extends outward of the top perimeter.

13. The drain assembly of claim 12, wherein the drain body includes a second fluid flow opening positioned below the annular upper opening, wherein the second fluid flow opening and the upper opening are non-concentric.

14. The drain assembly of claim 13, wherein the second fluid flow opening is one of a return bypass line and a hydrostatic inlet.

15. The drain assembly of claim 13, wherein the second fluid flow opening is positioned on a first side of the lower non-vented portion of the sidewall and the fluid flow opening is positioned on a second side of the lower non-vented sidewall different from the first side such that the second fluid flow opening is separate from the fluid flow channel defined by the non-vented sidewall and is not in fluid communication with the fluid flow opening except through the upper vented portion of the sidewall.

16. The drain assembly of claim 13, the annular upper opening comprising a longitudinal axis perpendicular to the planar cross-sectional area of the annular upper opening and the second fluid flow opening comprising a longitudinal axis, wherein the longitudinal axis of the fluid flow opening and the longitudinal axis of the second fluid flow opening are substantially parallel to each other.

17. The drain assembly of claim 16, wherein the drain body further comprises a third fluid flow opening positioned below and non-concentric with the annular upper opening, the third fluid flow opening comprising a longitudinal axis, and wherein the longitudinal axis of the third fluid flow opening is substantially parallel to the longitudinal axis of the second fluid flow opening.

18. The drain assembly of claim 16, wherein the second opening is a return line and the third opening is a hydrostatic inlet.

19. The drain assembly of claim 16, further comprising a flexible connector coupled between the cover sidewall and the fluid flow opening and securing the fluid flow channel from the sidewall to the fluid flow opening.

* * * * *